US005377715A

United States Patent [19]

Andenmatten et al.

[11] Patent Number: 5,377,715

[45] Date of Patent: Jan. 3, 1995

[54] METHOD FOR ELIMINATING HAZARDOUS MATERIALS FROM CARGO TANK WET LINES

[76] Inventors: Roy W. Andenmatten, 10 Eva La., Farmingville, N.Y. 11738; Ronald P. Andenmatten, 27 Otsego Ave., Dix Hills, N.Y. 11746

[21] Appl. No.: 973,487

[22] Filed: Nov. 9, 1992

[51] Int. Cl.[6] ..... B05B 3/14

[52] U.S. Cl. ..... 137/15; 137/209; 137/210; 137/240; 141/91; 141/113; 251/144

[58] Field of Search ..... 134/166 C; 141/67, 91, 141/113; 137/15, 209, 210, 240; 251/144

[56] References Cited

U.S. PATENT DOCUMENTS 3,989,070 11/1976 Liberg .
4,150,700 4/1979 Fox, Jr. .
4,216,185 8/1980 Hopkins .
4,469,143 9/1984 Vazin .
4,874,002 10/1989 Sundholm .
5,007,444 4/1991 Sundholm .

*Primary Examiner*—Gerald A. Michalsky
*Attorney, Agent, or Firm*—Morgan & Finnegan

[57] ABSTRACT

The invention disclosed relates to a method for purging hazardous or volatile materials from external loading lines fixed to the bottom of cargo tank compartments. According to the invention, pressurized gas is directed into each external loading line to force the material to the lowest point in the loading line, through a purging tube, and back into the cargo tank compartment. In one embodiment, the purging apparatus is wholly contained on the cargo tank. In another embodiment, the apparatus is partly contained on the cargo loading facility and partly contained on the cargo tank.

6 Claims, 15 Drawing Sheets

METHOD FOR ELIMINATING HAZARDOUS MATERIALS FROM CARGO TANK WET LINES

FIELD OF INVENTION

The present invention relates generally to cargo tank transport vehicles and, more particularly, to apparatus and methods for purging hazardous materials from cargo tank wet lines to eliminate the danger of a hazardous spill if the wet lines should break.

BACKGROUND OF THE INVENTION

Hazardous or volatile materials such as gasoline are primarily transported in bottom loading cargo tanks. Typically, each cargo tank has four or five compartments with an external loading/unloading line (hereinafter "wet line") mounted at the bottom center of each compartment. The cargo tank is loaded with liquid material which passes through the wet lines and into the compartments. After each compartment of the cargo tank is filled, a residual amount of between about- four and about ten gallons of the hazardous liquid material may remain in the corresponding wet line. Because the liquid material contained in the wet lines after loading has been metered and sold to the customer and because there are no convenient ways to remove this residual liquid material yet still deliver it to the customer, the current practice is to allow the liquid material to remain in the cargo tank wet lines during transportation.

Bottom loading cargo tank wet lines are particularly vulnerable to damage in traffic accidents, since the impact of an automobile will occur at the lower portion of the cargo tank (hereinafter "under-ride accidents"). In addition, bottom loading cargo tank wet lines are currently designed to fail upon impact during under-ride accidents in order to maintain the integrity of the tank compartments and prevent the release of the entire content of the cargo tank. Therefore, the transportation of hazardous materials in bottom loading cargo tanks presents the inherent risk of releasing hazardous materials from the cargo tank wet lines upon impact during an under-ride accident. Thus, there exists a pressing need to eliminate this inherent risk of transporting hazardous materials in bottom loading cargo tanks.

Presently, there is no known reliable technique to safeguard bottom loading cargo tank wet lines from rupturing upon impact and releasing the hazardous material. Previously, a proposal was made to construct a barrier or shield around the wet lines to protect them from breakage upon impact. However, the risk of breakage still exists if the impact is greater than the barrier can withstand. Further, a study by the American Petroleum Institute (the "A.P.I.") has suggested that efforts to safeguard bottom loading cargo tank wet lines with bottom damage protection structures are not cost effective. More recently, the A.P.I. has proposed conducting a study to identify feasible solutions to the problem of wet line breakage. Thus, there exists a compelling and industry recognized need for a reliable and cost effective method to eliminate the risk of carrying hazardous material in bottom loading cargo tanks.

OBJECTS AND SUMMARY OF THE INVENTION

A principal object of the present invention is to eliminate, virtually completely, the inherent risk created by carrying hazardous or volatile material in bottom loading cargo tank wet lines by providing a system to safely purge virtually all the material from the wet lines. The system according to the invention is primarily characterized by the use of pressurized gas to force virtually all of the liquid material from each wet line through a purging conduit and deliver it to the corresponding tank compartment.

It is a further object of this invention to incorporate into an existing bottom loading cargo tank an apparatus to purge virtually all the hazardous material which would otherwise remain in the wet lines after the compartment tanks have been loaded in the conventional manner.

It is still a further object of the invention to safely purge virtually all of the material from each cargo tank wet line and introduce it into the corresponding tank compartment without loss of any material.

It is still a further object of the invention to safely purge virtually all of the material from the cargo tank wet lines in a manner which prevents material from being drawn from the loading facility coupler lines.

It is still a further object of the invention to include within the purging apparatus appropriate valving and circuitry to enable the cargo tank wet lines to be purged independently.

It is still a further object of the invention to provide a purging apparatus which can be essentially completely installed on the cargo tank.

It is still a further object of the invention to provide an alternative purging apparatus which can be installed partly on the loading facility and partly on the cargo tank.

Objects and advantages of the invention are set forth in part above and in part below. In addition, these and other objects and advantages of the invention will become apparent herefrom, or may be appreciated by practice with the invention, the same being realized and attained by means of instrumentalities, combinations and methods pointed out in the appended claims. Accordingly, the present invention resides in the novel parts, constructions, arrangements, improvements, methods and steps herein shown and described.

DETAILED DESCRIPTION OF PREFERRED EMBODIMENTS

Figure 1:
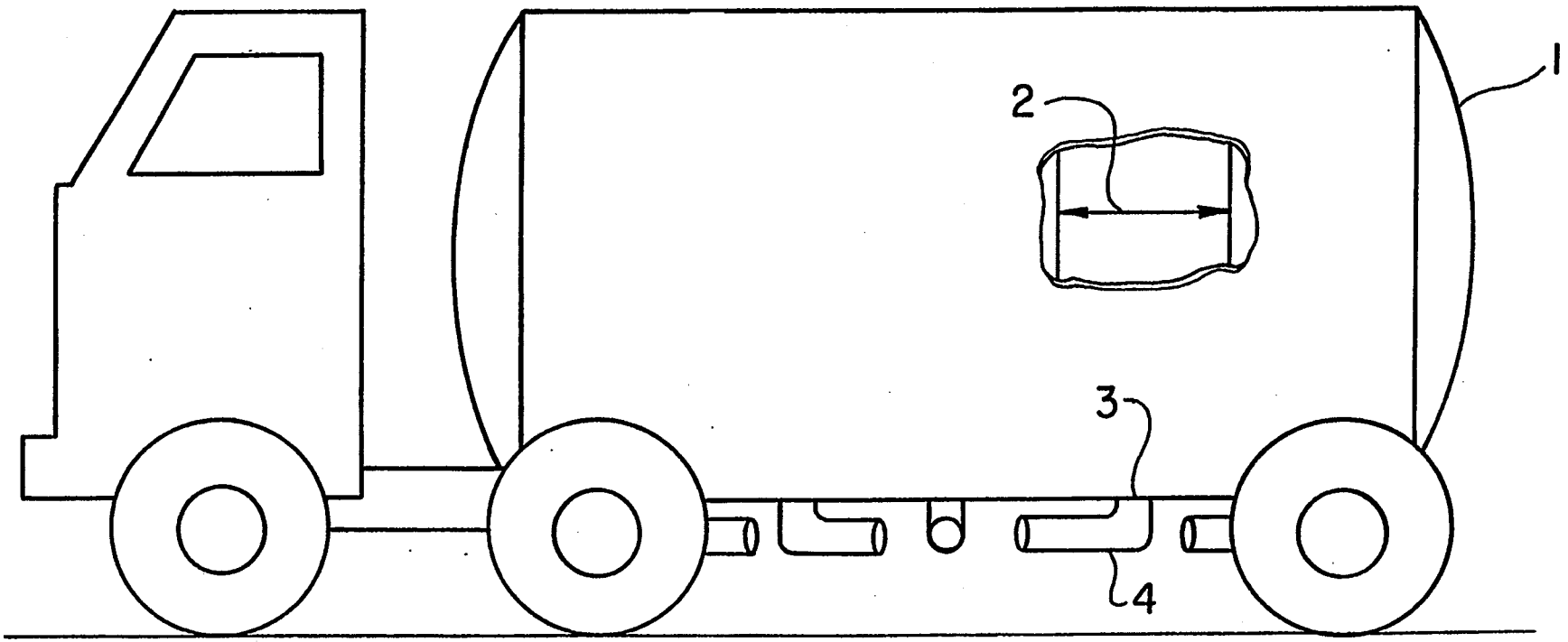
FIG. 1 is an elevation view of a bottom loading cargo tank to which this invention may be applied.
Figure 2:
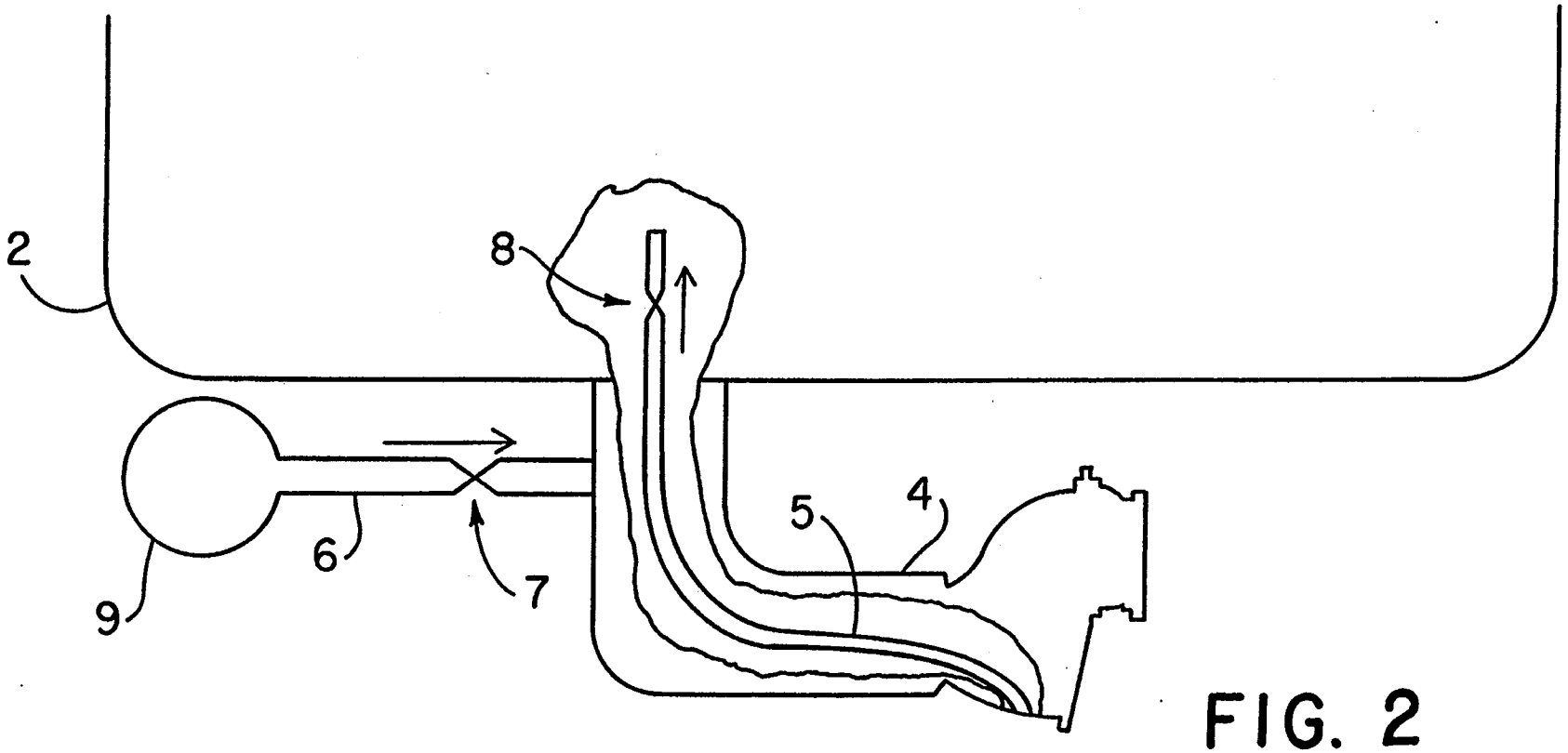
FIG. 2 is an elevation view, with partial cut-away, of a cargo tank wet line to illustrate the principle of the purge apparatus according to the present invention.
Figure 2A:
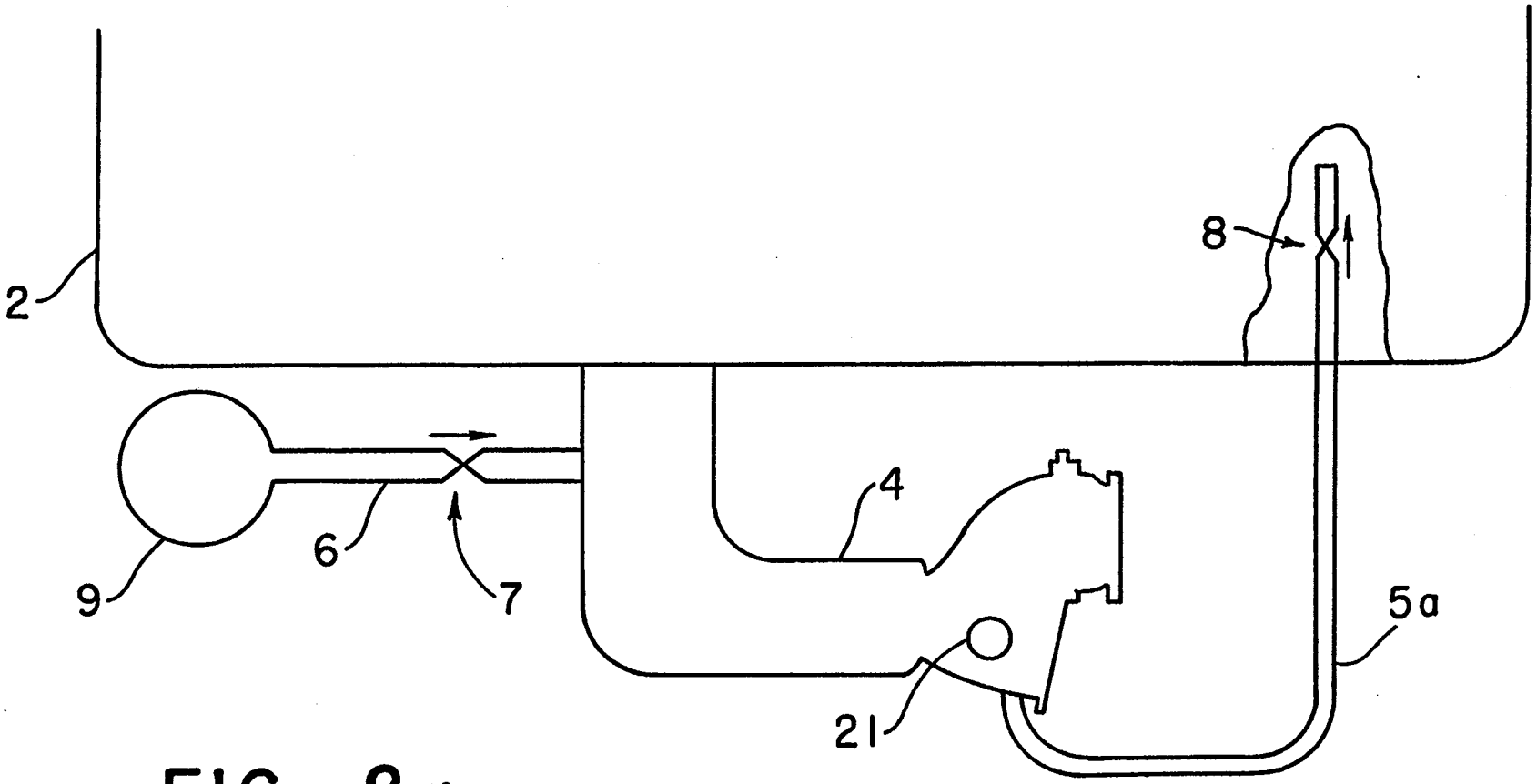
FIG. 2*a* is an elevation view, with partial cut-away, of an alternative configuration of the apparatus illustrated in FIG. 2.

Referring generally to the embodiments of the invention shown in the accompanying drawings, wherein like reference numbers refer to like parts throughout the various views, the basic principles of the broadest aspect of the invention can be appreciated from FIGS. 1-2*a*.

As shown in FIG. 1, a bottom loading cargo tank 1 includes a plurality of tank compartments 2, each of which is an individual tank suitable for carrying liquid material. Centrally located at the bottom of each tank compartment 2 is a valved compartment port 3, each of which is in flow communication with a corresponding wet line 4. Tank compartments 2 are loaded in a conventional manner which includes: (1) connecting a grounding wire to the cargo tank; (2) connecting an overfill system to the cargo tank; (3) connecting the loading facility vapor recovery coupler to the cargo tank vapor recovery system (4) lifting the cargo tank interference gate and thereby providing access to the wet lines; (5) connecting the wet lines to the loading facility coupler lines via dry break couplings; (6) setting the meter to the total amount of material desired to be loaded into the tank compartments; and (7) pumping the material from the loading facility, through each wet line 4 and valved compartment port 3, and into the corresponding tank compartment 2. After the tank compartments 2 have been loaded, the dry break couplings are disconnected from the wet lines 4, thereby leaving a substantial amount of material to be transported in the wet line until actually delivered to the customer.

The present invention, illustrated in its most basic form in FIG. 2, enables a simple means for removing the material from the wet lines so that the cargo is transported with "dry" wet lines. As here embodied, an internal purging conduit 5 is positioned essentially entirely inside wet line 4, such that the inlet end is coupled, preferably, at the lowest point within the wet line and the outlet end extends through valved compartment port 3 and into the corresponding tank compartment 2. As also embodied, purging conduit 5 includes a one-way flow valve 8 at the outlet end which prevents the flow of material from the tank compartment back into wet line 4. In addition, a flow control conduit 6 couples the interior of wet line 4 to a source of purging medium 9, preferably a source of pressurized gas. Also, one-way flow valve 7 may be located in flow control conduit 6 to prevent liquid material and pressurized gas from flowing back into the flow control conduit.

Alternatively, as illustrated in FIG. 2*a*, the purging conduit (indicated here at 5*a*) may be positioned essentially entirely outside the wet line 4, with the inlet end coupled to the lowest point within the wet line and the outlet end extending into the corresponding tank compartment 2.

According to the basic principle of the invention and referring to FIGS. 2 and 2*a*, the wet line 4 is purged as follows:

After the tank compartments have been loaded in the conventional manner and the dry break couplings have been disconnected, the purging medium, preferably a pressurized inert gas, is introduced into each wet line 4 through a corresponding flow control conduit 6. The pressurized gas then tends to force the residual liquid within the wet line towards the lowest point inside the wet line 4. When the gas pressure within the wet line exceeds the threshold of one-way flow valve 8, the residual liquid is then forced through purging conduit 5 and into the tank compartment 2. Because the purging conduit inlet is at the lowest point of the wet line, virtually all of the residual liquid in the wet line is evacuated from the wet line 4 and introduced into the tank compartment 2, as will also be explained more fully hereafter.

Figure 3:
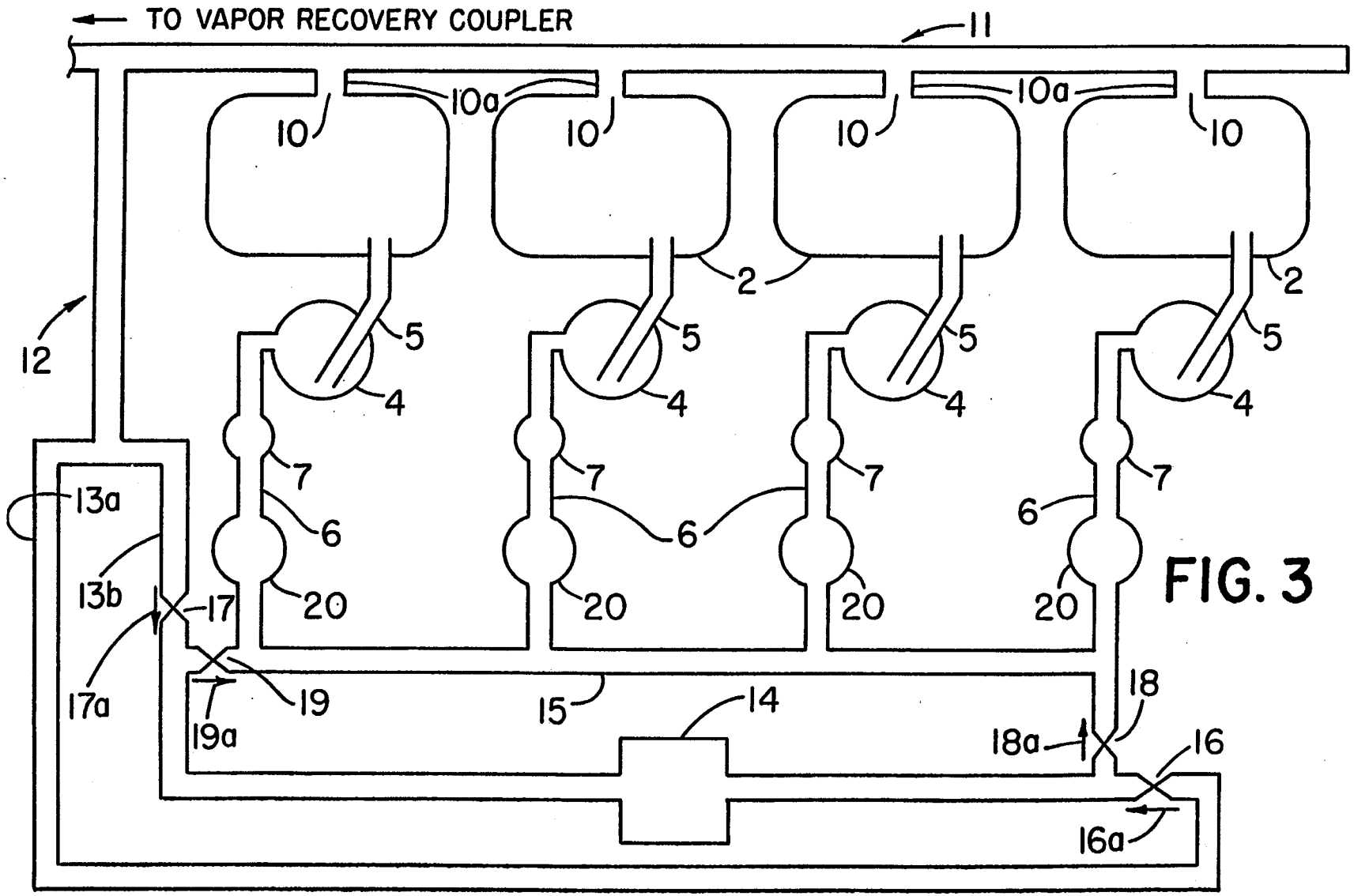
FIG. 3 is a schematic diagram of one embodiment of a wet line purging apparatus according to the present invention.

In a preferred form of the invention, the purging apparatus and the purging medium are entirely contained on the cargo tank. One embodiment of this form of the invention, as illustrated in FIG. 3, uses the vapors within the tank compartments as the purging medium. Use of the tank vapors is advantageous because the vapors are readily available and will be rendered essentially non-combustible when introduced into the wet lines since they are highly saturated vapors having virtually no oxygen content.

As shown in FIG. 3, this embodiment utilizes the existing cargo tank compartment vapor recovery system which includes a vapor recovery conduit 11 coupled through branch conduits 10*a* to compartment vapor valves 10 located at the top of each tank compartment 2. To this end, vapor recovery conduit 11 is furnished with outlet conduit 12 providing flow communication between vapor recovery conduit 11 and pump 14. Pump 14 is coupled to outlet conduit 12 by branch conduits 13*a* and 13*b*.

Also shown in FIG. 3, a plurality of wet lines (each generally indicated at 4) are provided in flow communication with pump 14 by branch conduits 13*a* and 13*b*. Each branch conduit 13*a* and 13*b* is coupled to an opposite end of conduit 15. Each wet line 4 is coupled to conduit 15 by a separate flow control conduit 6. It will be understood that each flow control conduit 6 may include a flow control valve 20 to regulate the flow of pressurized gas from pump 14 to wet line 4. Also, flow control conduit 6 may have a one-way flow valve 7 located downstream of flow control valve 20 to prevent the flow of pressurized gas or liquid material from wet line 4 back into flow control line 6.

As will be described more fully below, pump 14 preferably operates to alternately: (1) draw vapors from tank compartments 2 through vapor recovery conduit 11, outlet conduit 12, and branch conduit 13*a* while simultaneously discharging pressurized vapors into wet lines 4 through branch conduit 13*b*, conduit 15, and flow control conduits 6; and (2) discharge pressurized vapors into wet lines 4 through branch conduit 13*a*, conduit 15, and flow control conduits 6 while simultaneously drawing vapors from tank compartments 2 through vapor recovery conduit 11, outlet conduit 12, and branch conduit 13*b*. Accordingly, branch conduits 13*a* and 13*b* and conduit 15 are adapted to permit both the flow of unpressurized vapor from tank compartments 2 to pump 14 and the flow of pressurized vapor from pump 14 to wet lines 4. To this end, each branch conduit 13*a* and 13*b* includes a one-way flow valve 16 and 17, respectively, positioned between outlet conduit 12 and conduit 15 to permit the flow of vapors in the direction indicated by arrows 16*a* and 17*a*, respectively. Similarly, conduit 15 includes two one-way flow valves 18 and 19, positioned as close as possible to each junction with branch conduits 13*a* and 13*b*, respectively, to permit the flow of pressurized vapors in the direction indicated by arrows 18*a* and 19*a*, respectively. One-way flow valves 16, 17, 18, and 19 are, preferably, dilating O-ring check valves such as the series CV1/2 sold by Flair-Line, Inc. of Farmington, Mich. One-way flow valves 16 and 17 are adapted to permit the flow of vapors from outlet conduit 12 to pump 14 when the vapor pressure in pump 14 falls below a prescribed limit. Conversely, one-way valves 18 and 19 are adapted to permit the flow of pressurized vapors from pump 14 to wet lines 4 when the vapor pressure in branch conduit 13*a* and 13*b*, respectively, exceeds a prescribed limit. It will be understood that the prescribed limit for one-way flow valves 18 and 19 will be greater than the vapor pressure of the tank vapors in outlet conduit 12, such that when one-way flow valves 16 and 17 open and permit the flow of vapors from outlet conduit 12 through branch conduits 13*a* and 13*b*, respectively, these vapors will not pass through one-way flow valves 18 and 19 and into conduit 15.

Figure 3A:
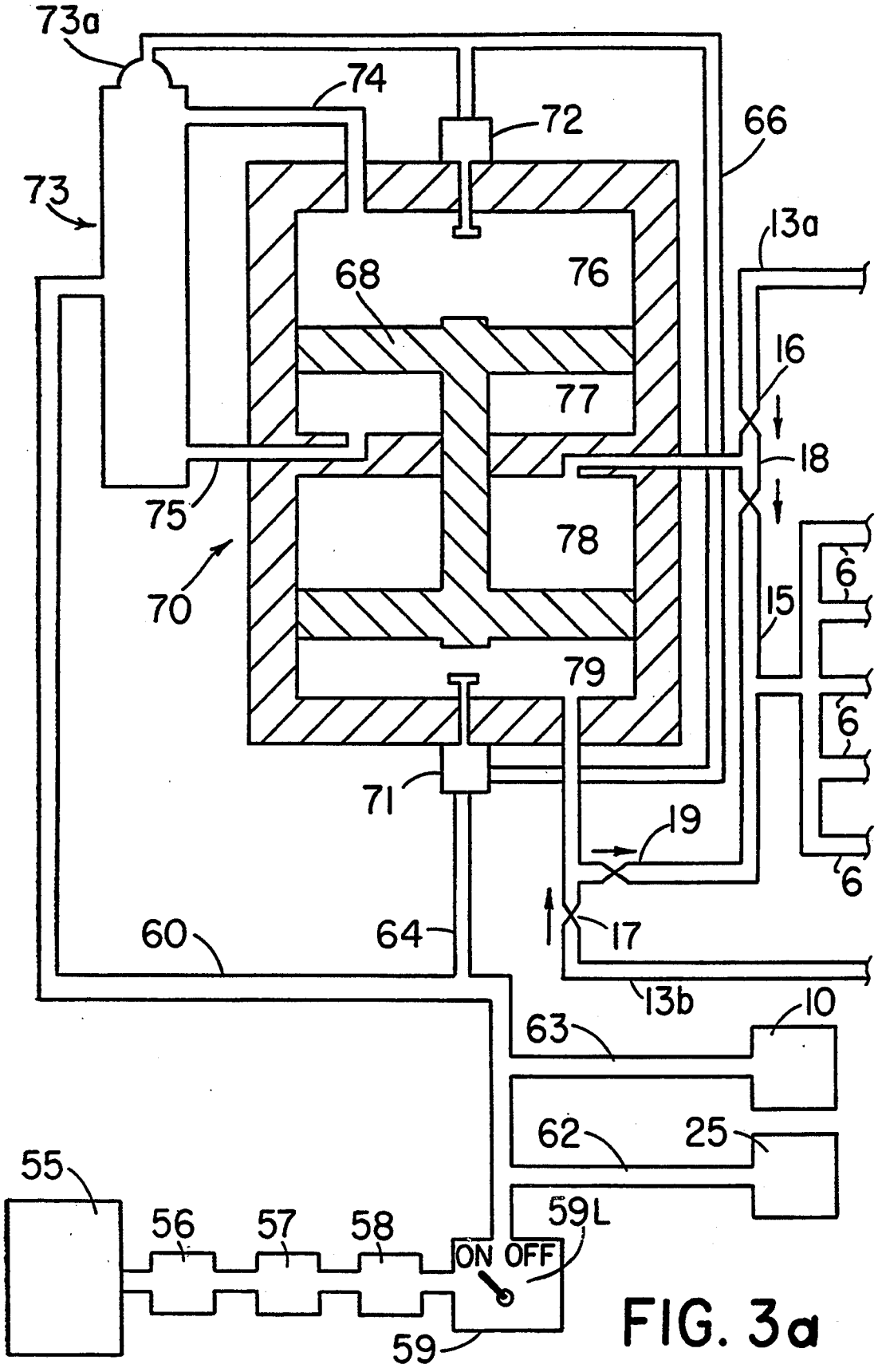
FIG. 3*a* is a schematic diagram of a preferred form of the pump shown in the embodiment described in FIG. 3.

As preferably embodied, pump 14 is adapted to provide a constant flow of pressurized vapors to wet lines 4. Referring now to FIG. 3*a*, pump 14 preferably consists of an air-operated vapor transfer pump 70 having two two-way normally-closed piston position sensing valves 71 and 72 and a pilot-operated, four-way directional control valve 73. As here embodied, a source of pressurized gas 55, preferably dry air, is provided in flow communication with the inlet of four-way directional control valve 73 by lead conduit 60. Four-way directional control valve 73, in turn, is coupled to air-operated vapor transfer pump air chambers 76 and 77 by flow conduits 74 and 75, respectively. In addition, lead conduit 60 is coupled to first branch conduit 62, second branch conduit 63 and third branch conduit 64 which, in turn, are coupled, respectively, to the cargo tank brake interlock system 25, tank compartment vapor valves 10, and the inlet of piston position sensing valve 71. Lead conduit 60, may include air filter 56, pressure regulator 57, lubricator 58, and three-way control valve 59 positioned in series between the source of pressurized dry air 55 and the junction with first branch conduit 62.

As described with reference to FIG. 3*a*, the purging operation for the embodiment illustrated in FIG. 3 is initiated by shifting the three-way control valve lever (indicated at 59L in FIG. 3*a*) from the "OFF" position to the "ON" position to open normally closed, three-way control valve 59. Pressurized dry air is thereby permitted to flow from the source of dry air, through air filter 56, pressure regulator 57, lubricator 58, and three-way control valve 59 to (1) activate the cargo tank brake interlock system 25, (2) open the tank compartment vapor valves 10, (3) pressurize the inlet of piston position sensing valve 71, and (4) pressurize the inlet of pilot-operated, four-way directional valve 73. Assuming that the vapor transfer pump piston 68 is not contacting either piston position sensing valve 71 or 72, four-way directional control valve 73 directs pressurized dry air through flow conduit 74 into air chamber 76.

Pressurization of air chamber 76 forces vapor transfer pump piston 68 to move downward, thereby simultaneously (1) expelling dry air from chamber 77; (2) drawing unpressurized tank vapor from tank compartments 2, through vapor recovery conduit 11, outlet conduit 12, branch conduit 13*a*, valve 16, and into chamber 78; and (3) pressurizing tank vapor in chamber 79. Concurrently, pressurized tank vapor from chamber 79 is discharged through branch conduit 13*b*, valve 19, conduit 15, and into a plurality of flow control conduits 6. When vapor transfer pump piston 68 completes the downward stroke, it contacts and thereby momentarily opens two-way normally closed piston position sensing valve 72. While piston position sensing valve 71 is open, pressurized dry air flows through conduit 66 and simultaneously pressurizes the inlet of piston position sensing valve 72 and pilot 73*a* of four-way directional control valve 73. Pressurization of pilot 73*a* causes four-way directional valve 73 to then shut off the flow of pressurized dry air to air chamber 76 and direct pressurized dry air through flow conduit 75 into air chamber 77. Pressurization of air chamber 77 causes vapor transfer pump piston 68 to reverse direction, thereby simultaneously (1) expelling dry air from chamber 76; (2) drawing unpressurized vapor from tank compartments 2, through vapor recovery conduit 11, outlet conduit 12, branch conduit 13*b*, valve 17, and into chamber 79; and (3) pressurizing tank vapor in chamber 78. Concurrently, pressurized tank vapor from chamber 78 is discharged through branch conduit 13*a*, valve 18 conduit 15, and into a plurality of flow control conduits 6. When vapor transfer-pump piston 68 completes the upward stroke, it contacts and momentarily opens two-way normally closed piston position sensing valve 72 which, in turn, simultaneously exhausts the pressurized dry air from conduit 66 and depressurizes pilot 73*a*. Depressurization of pilot 73*a* causes four-way directional control valve 73 to then shut off the flow of pressurized dry air to air chamber 77 and direct pressurized dry air through flow conduit 74 into air chamber 76. During the purging process, pump 14 continuously operates in this manner thereby delivering a constant flow of pressurized vapors through branch conduits 13*a* and 13*b*, conduit 15, flow control conduits 6, and into wet lines 4.

The pressurized gas within the wet lines forces the liquid material to the lowest point in the wet line where it enters the inlet end of purging conduit 5, passes through the purging conduit and discharges into the tank compartment 2 (as will be described more fully hereafter). To provide for efficient purging of all the wet lines 4, it is desired that they be purged within approximately the same time period. However, since the wet lines 4 may differ in size and, therefore, contain variable amounts of residual liquid material following the conventional loading procedure, it is preferable to regulate the relative flow of pressurized gas into each wet line. To this end, flow control valves 20 are preferably flow control meter valves, such as the series K75 sold by King Instruments Co. of Huntington Beach, Calif., which can be adjusted and calibrated to regulate the flow of pressurized gas passing through each flow control conduit by varying the size of the valve orifice. It will be understood that the size of the valve orifice for each flow control meter valve will be selected so that all of the wet lines will be virtually completely purged of residual liquid material at approximately the same time. Once it is determined that the wet lines have been virtually completely purged of the residual liquid, as by observation through a sight glass (indicated at 21 in FIG. 2*a*) or by detecting the drop in pressure in the wet lines with the use of a pressure gauge (not shown), three-way control valve lever 59L is shifted from the "ON" position to the "OFF" position to deactivate pump 14, close tank compartment vapor valves 10, and deactivate cargo tank brake interlock system 25.

Figure 4:
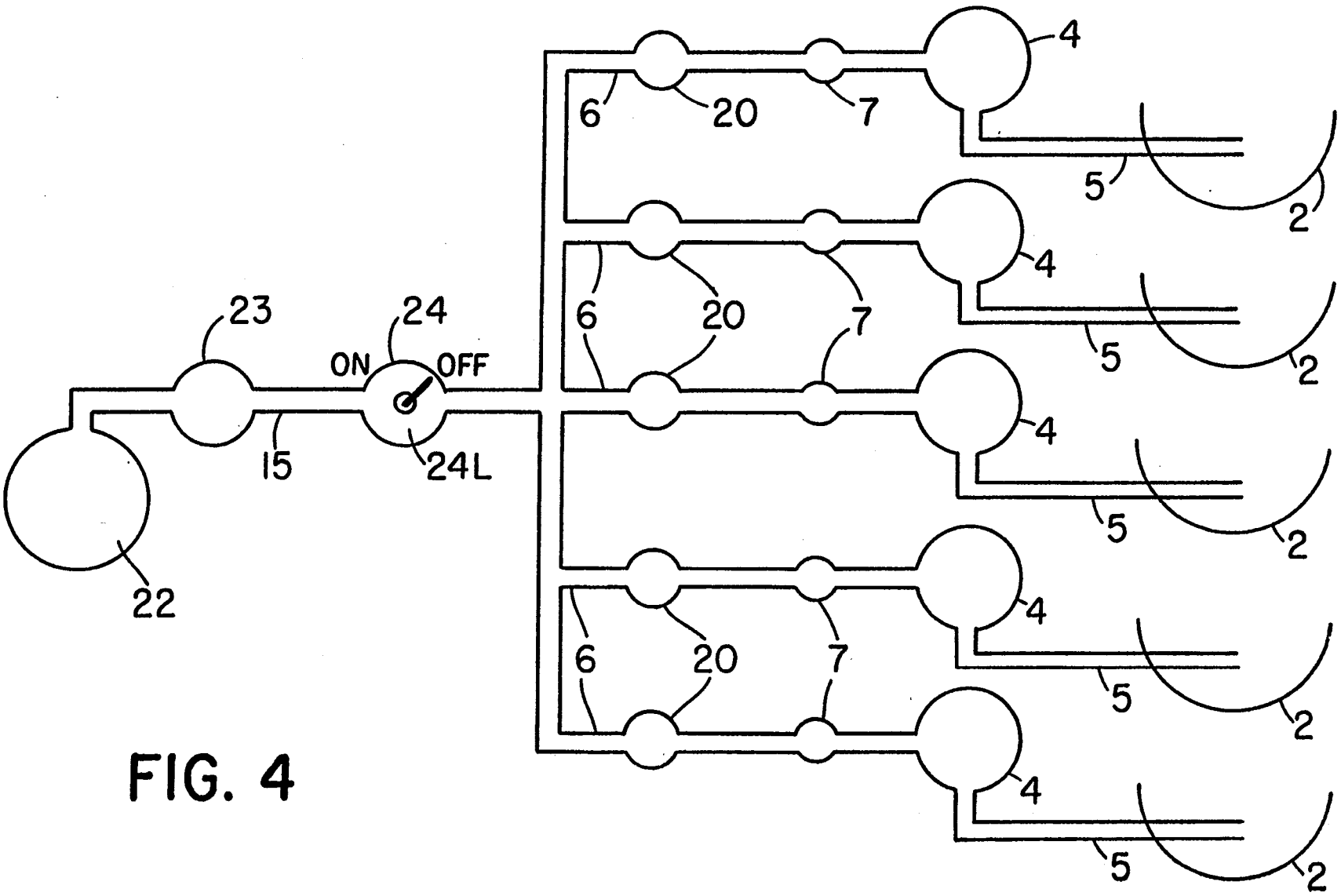
FIG. 4 is a schematic diagram of the embodiment described in FIG. 3 wherein the source of pressurized gas is a pre-pressurized container of gas.

Another embodiment of this form of the invention is illustrated in FIG. 4. The embodiment in FIG. 4 is essentially the same as the embodiment shown in FIG. 3 except that the source of pressurized gas used is a container of pressurized inert gas 22 housed on the cargo tank instead of pressurized tank compartment vapors. In this embodiment, the container of pressurized gas 22, preferably an inert gas such as carbon dioxide or nitrogen, is provided in flow communication with a plurality of wet lines (each generally indicated at 4) by conduit 15. Each wet line 4 is coupled to conduit 15 by a separate flow control conduit 6. It will be understood that conduit 15 may include a pressure regulator 23, such as the series SR-310–320 sold by Victor of Denton, Tex., which provides a constant gas pressure entering the wet lines 4 during the standard purging operation at, for example, 5 PSI and a normally-closed three-way control valve 24 which, when opened, permits the flow of pressurized gas from container 22 to wet lines 4. In addition, each flow control conduit 6 preferably includes the same flow control meter valve 20 and one-way flow valve 7 described above with regard to the embodiment shown in FIG. 3.

In operation, when initiation of this purging system is desired, control valve lever (indicated at 24L in FIG. 4) is shifted from the "OFF" position to the "ON" position to open flow control valve 24. Pressurized gas from container 22 of pressurized inert gas is thereby permitted to flow through conduit 15 and into the flow control conduits 6. Then the pressurized gas passes through flow control meter valves 20, one-way flow valves 7, and into the wet lines 4. Pressurization of the wet lines forces the liquid material to the lowest point within each wet line where it enters the inlet end of purging conduit 5 and is directed back into the corresponding tank compartment 2 substantially as described above with reference to FIG. 3. Once it is determined that the wet lines have been virtually completely purged of the residual liquid material, as by observation through a sight glass (indicated at 21 in FIG. 2*a*) or by detecting the drop in pressure within the wet lines with the use of a pressure gauge (not shown), control valve lever 24L is shifted from the "ON" position to the "OFF" position.

Figure 8:
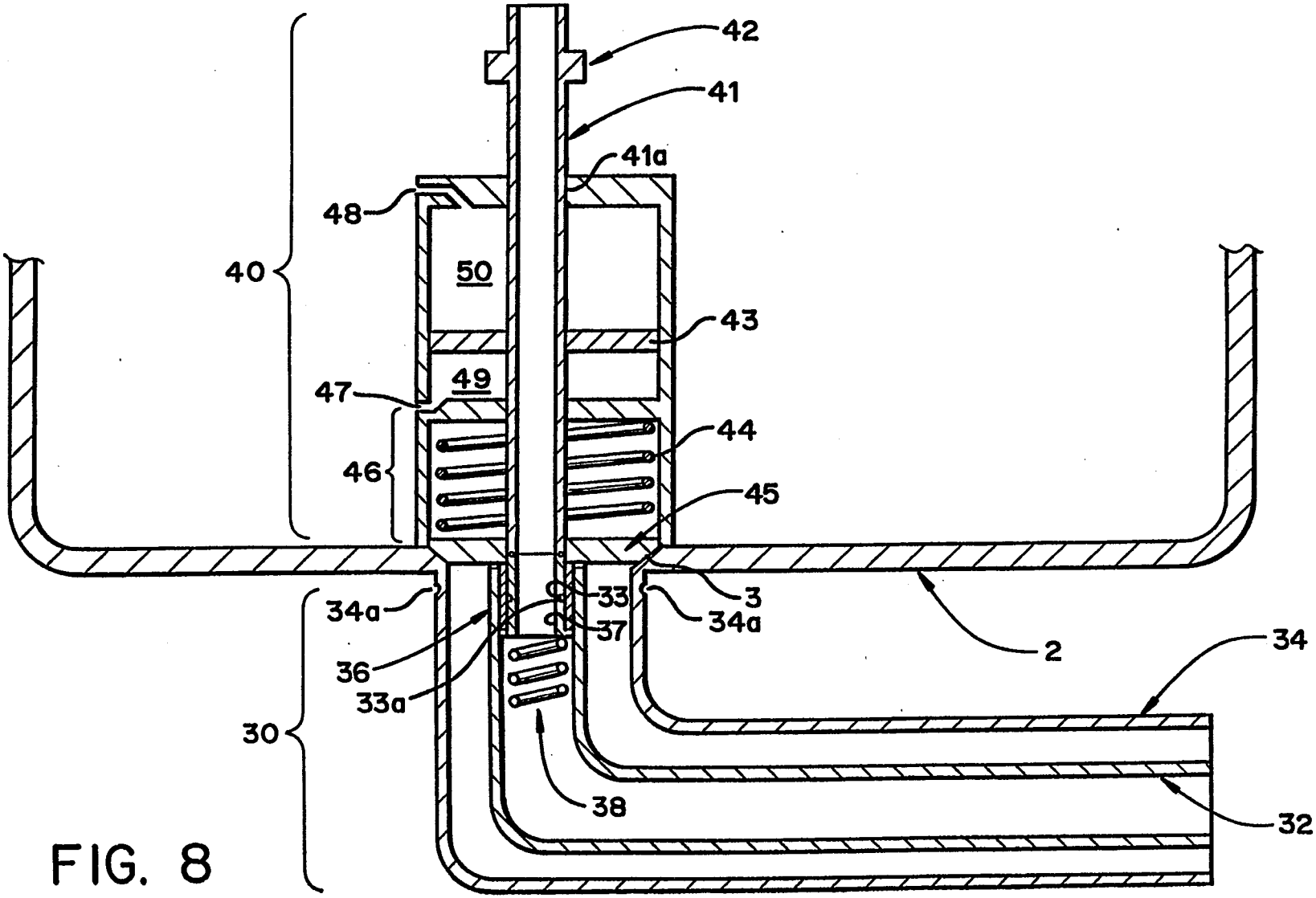
FIG. 8 illustrates a vertical sectional view of the compartment valve assembly utilized in the embodiments described in FIGS. 2-6 which incorporate the preferred internal purge conduit.

According to another feature of the invention, embodiments having the preferred internal purging conduit 5, generally illustrated in FIG. 2, are adapted to include the specialized compartment valve assembly shown in FIG. 8 to provide flow communication between internal purging conduit 5 and the corresponding tank compartment 2. As here embodied, the compartment valve assembly consists of a dual functioning compartment valve 40 and a piping connector 30 (described hereafter with reference to FIGS. 9 and 10, respectively). The compartment valve assembly is advantageous because it allows for both (1) loading and unloading of the tank compartment through the wet line in generally the same operation as conventionally practiced and (2) purging of liquid material from the wet line 4, through an internal purging conduit 5, and back into the tank compartment 2.

Figure 9:
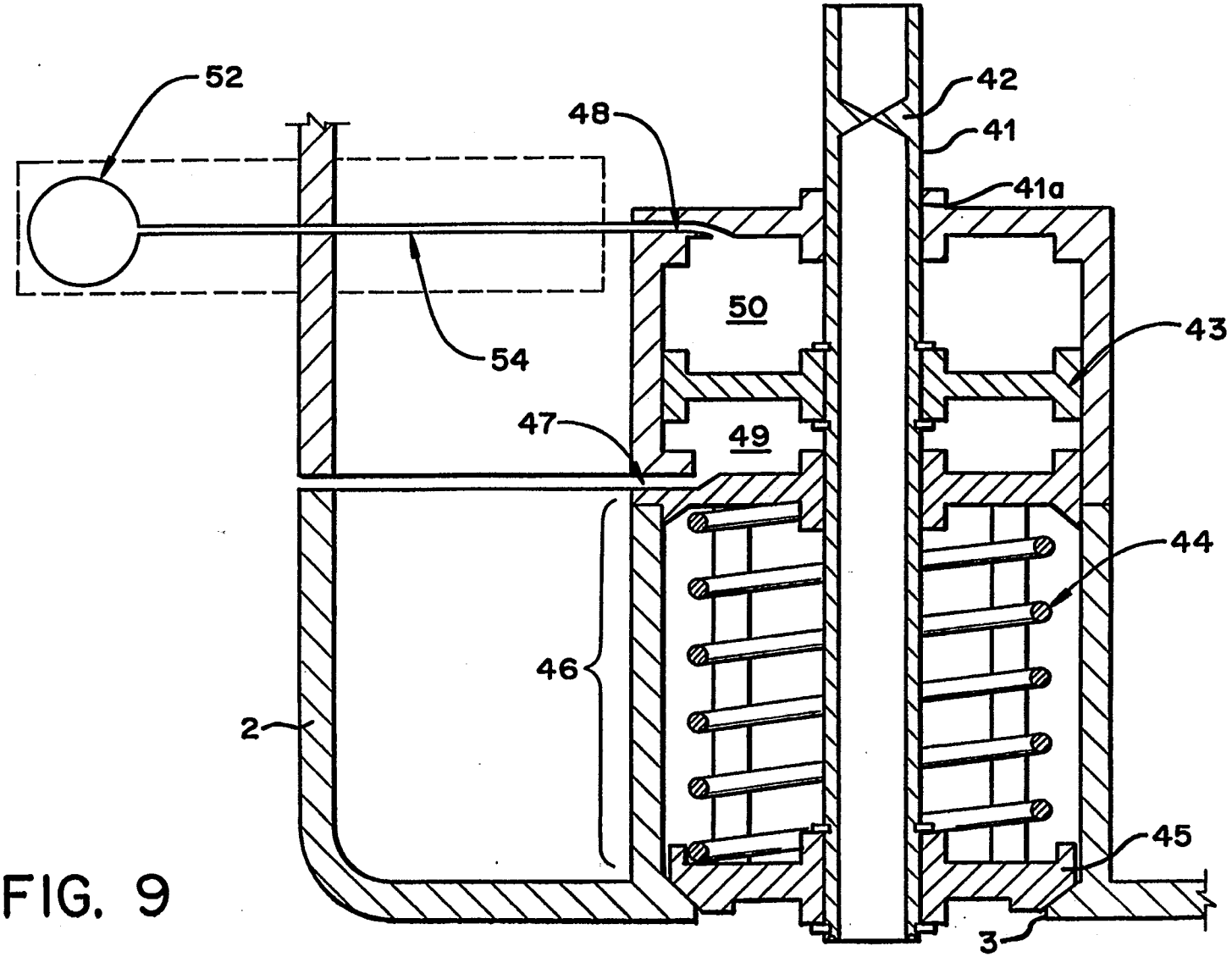
FIG. 9 illustrates a vertical sectional view of the dual functioning compartment valve utilized in the embodiments described in FIGS. 2-6 which incorporate the preferred internal purge conduit.

As shown in FIG. 9, dual functioning compartment valve 40 consists of a conventional air-operated overcompensating compartment valve, such as the series BLV-300 sold by BOMAR Tank Discharge Systems, Inc. of Brooklyn, N.Y., which is specially adapted to have (1) a hole 41*a* extending vertically throughout its center and (2) a hollow shaft 41 slidably mounted within the hole and operatively coupled to piston 43 and bottom valve plate 45. The outlet end of hollow shaft 41 extends into tank compartment 2 and includes a one-way flow valve 42 to prevent the flow of liquid material from the tank compartment 2 back into the wet line 4. The inlet end of hollow shaft 41 is coupled to piping connector 30.

Figure 10:
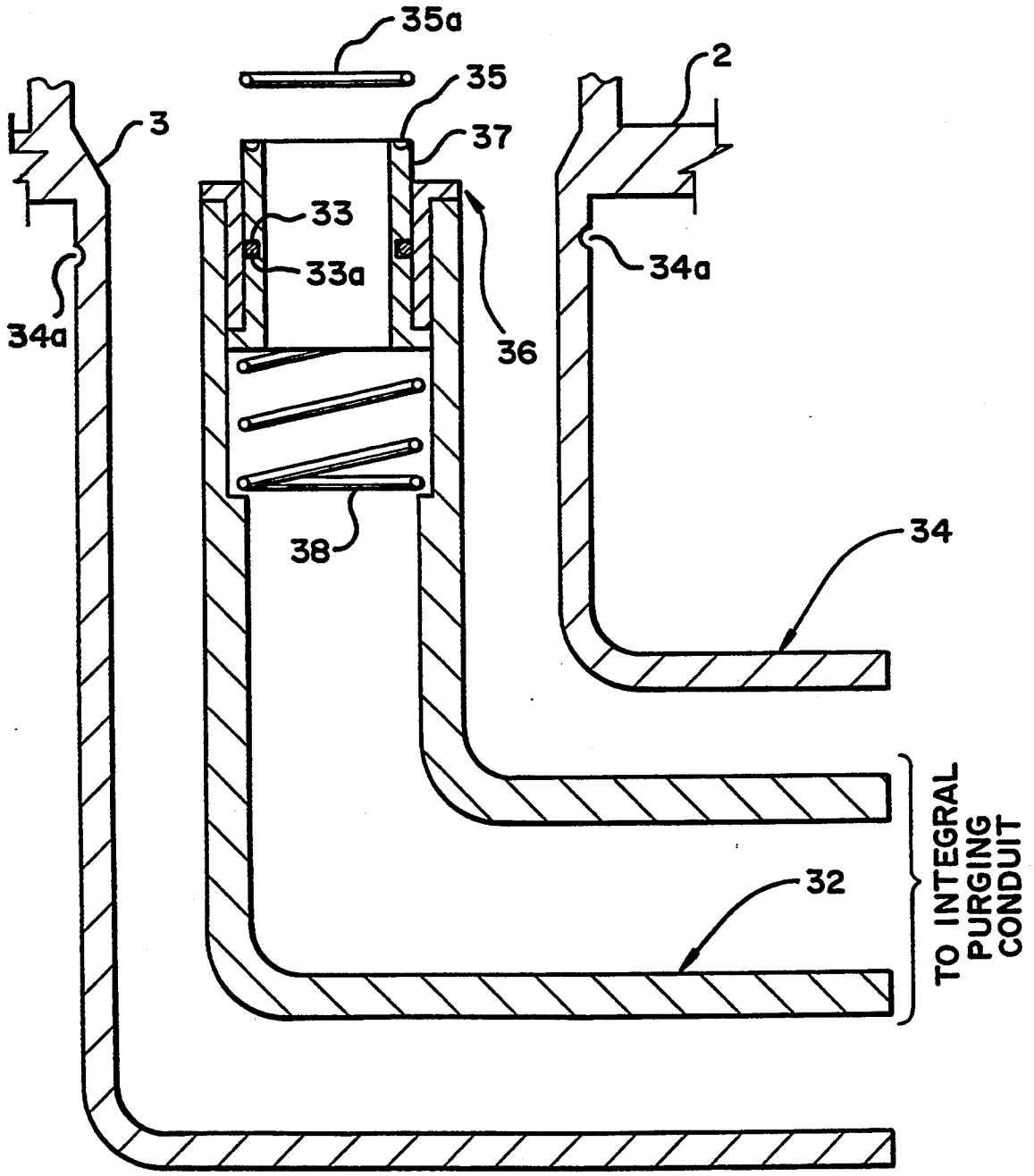
FIG. 10 illustrates a vertical sectional view of the piping connector utilized in the embodiments described in FIGS. 2-6 which incorporated the preferred internal purge conduit.

As illustrated in FIG. 10, piping connector 30 consists of a pipe-within-a-pipe structure wherein an internal pipe 32 is supported inside and extends throughout the length of an external pipe 34. External pipe 34 is coupled at one end to the wet line 4 and at the other end to the tank compartment 2 at compartment port 3. Internal pipe 32 is coupled at one end to the internal purging conduit 5 and its other end terminates at a position adjacent to the inlet end of hollow shaft 41.

As further illustrated in FIG. 10, internal pipe 32 is provided with bushing 36, valve seat 37, and helical compression spring 38 at the end adjacent to hollow shaft 41. As here embodied, bushing 36 consists of a hollow cylindrical tube having a flanged lip at its top end. Bushing 36 is mounted to internal pipe 32 such that the flanged lip at the top end abuts the end of internal pipe and the bottom end extends into internal pipe 32. Valve seat 37 consists of a hollow cylindrical tube having a flanged lip at its bottom end and is slidably mounted inside bushing 36 such that the flanged lip at the bottom end of valve seat 37 abuts the end of bushing 36 which extends into the internal pipe 32. Valve seat 37 includes a grooved notch 33 on its external surface midway between its top end and bottom end such that an O-ring (shown at 33*a* in FIG. 10) may fit inside the grooved notch and provide a leak-proof seal between the external surface of valve seat 37 and the internal surface of bushing 36. Valve seat 37 further includes a grooved notch 35 on the upper surface of its top end in which an O-ring (shown at 35*a* in FIG. 10) may sealingly engage. Helical compression spring 38 is fixedly mounted at its bottom end to the inside of the internal pipe 32 and at its upper end to the bottom of valve seat 37 such that it provides resilient support for valve seat 37.

Referring back to FIG. 8, conventional loading and unloading of tank compartment 2 using compartment valve assembly is effected by introducing pressurized air through air duct 47 into chamber 49 and concurrently exhausting air from chamber 50 through air duct 48. The resultant air pressure against piston 43 moves the piston along with hollow shaft 41 and valve plate 45 upward against the bias of spring 44 thereby permitting the flow of material through wet line 4, external pipe 34, compartment port 3 and caged housing 46. After the tank compartment 2 has been loaded, the pressurized air is exhausted from chamber 49 thereby permitting the force of compression spring 44 to sealingly close valve plate 45 to tank compartment port 3.

In addition, when dual functioning compartment valve 40 is closed, valve seat 37 sealingly engages hollow shaft 41 by the O-ring 35*a* to provide a continuous passageway from the inlet of internal purging conduit 5 to the outlet end of hollow shaft 41 to permit purging of the residual liquid material from the wet line 4 into the corresponding tank compartment 2. Therefore, in performing the purging operation as described above with reference to the embodiments shown in FIGS. 3 and 4, pressurization of wet line 4 forces the residual liquid material to the lowest point within the wet line; into the inlet end of the purging conduit; through the purging conduit 5, internal pipe 32 and hollow shaft 41; and into the tank compartment 2. It will be understood that to perform the purging operation with embodiments of the present invention which employ the preferred internal purging conduit 5 and compartment valve assembly, it is necessary to maintain the seal between (1) valve plate 45 and compartment port 3 and (2) hollow shaft 41 and valve seat 37. To this end, the compression force of spring 44 is preferably selected to be greater than the force imposed by the pressurized gas within wet line 4 on valve plate 45 during the purging operation (except for the quick purge operation described hereafter).

The compartment valve assembly also provides a true breakaway section between wet line 4 and compartment tank 2. As explained above, internal pipe 32 is designed to engage and disengage with the inlet end of hollow shaft 41 through valve seat 37 and although external pipe 34 is fixedly connected to the tank compartment 2, it is preferably provided with a designed breakaway point 34*a* at the base of the connection. Therefore, in the event of an under-carriage impact to piping system 30 or wet line 4, external pipe 34 will break at the base of tank compartment 2 and internal pipe 32 will separate from hollow shaft 41 along valve seat 37, but leave the dual functioning compartment valve 40 intact and sealed to the tank compartment port 3 without any loss of liquid.

Figure 7:
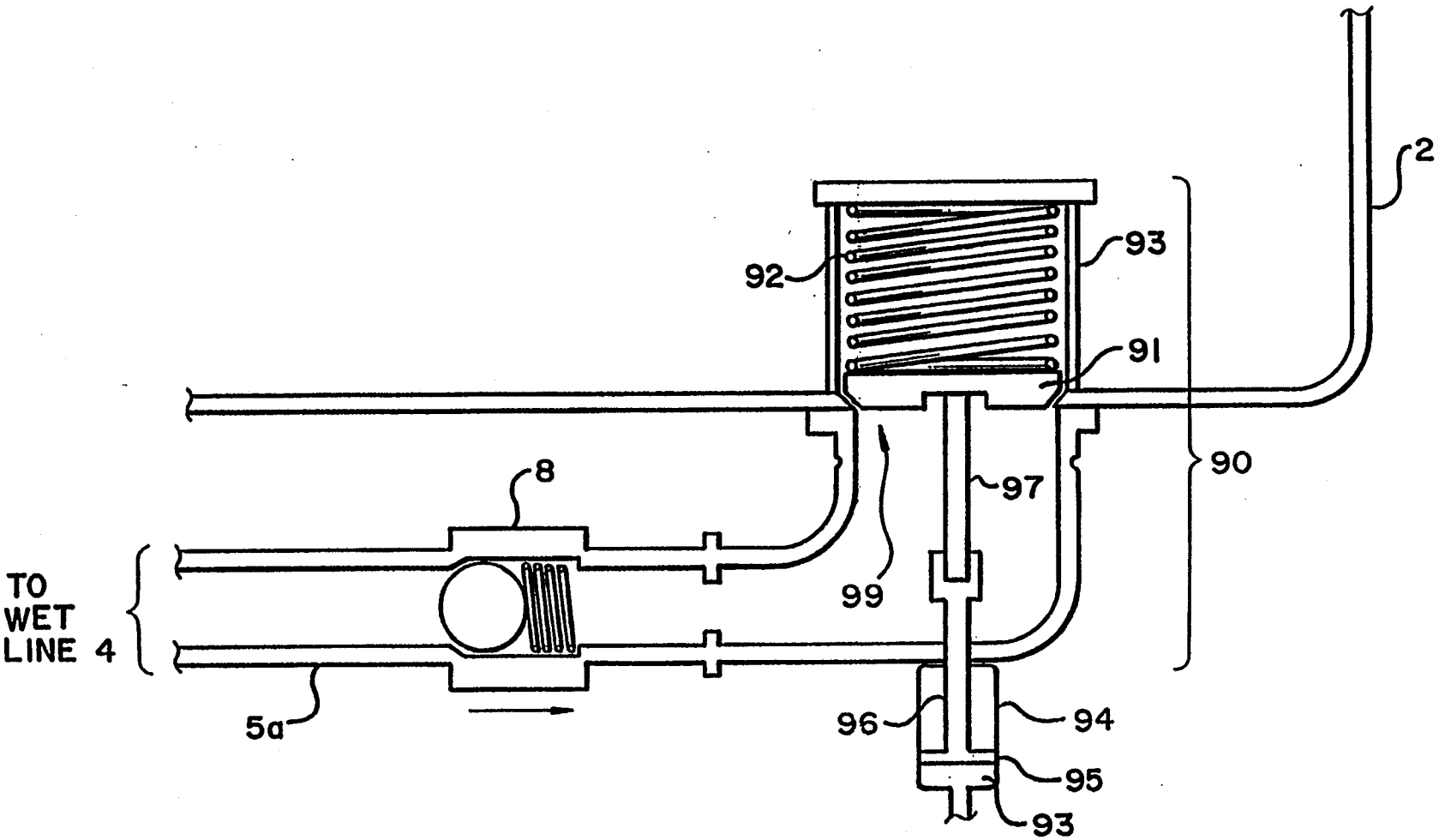
FIG. 7 illustrates a vertical sectional view of a preferred connection between the external purging conduit and the tank compartment in the embodiments described in FIGS. 2-6 which incorporate the external purging conduit.

Alternatively and referring to FIG. 7, embodiments of the present invention having an external purging conduit of the type indicated at 5*a* in FIG. 2*a* preferably include an air-operated, spring-loaded valve 90, such as the series SDV-100 sold by BOMAR Tank Discharge Systems, Inc. of Brooklyn, N.Y., located at the outlet end of the purging conduit to provide a positive closure seal when the wet lines are not being purged. The outlet end of external purging conduit 5*a* is coupled to the corresponding tank compartment 2 through valve 90 at compartment port 99. Valve 90 is mounted on the inside of tank compartment 2 such that when valve 90 is closed, valve plate 91 provides a positive closure seal to compartment port 99. When wet line 4 is being purged, valve plate 91 is lifted from compartment port 99 thereby permitting liquid material to pass through external purging conduit 5*a*, compartment port 99, caged housing 93 and into tank compartment 2. Preferably, valve 90 is opened by an air-operated cylinder 94. As here embodied, when the purging operation is initiated, pressurized air is introduced into cylinder chamber 98. The resultant air pressure against piston 95 moves the piston, shaft 96, linker arm 97 and valve plate 91 upward against the bias of compression spring 92, thereby permitting the flow of liquid material from external purging conduit 5*a* to tank compartment 2. After the purging operation is completed, pressurized air is exhausted from chamber 98, thereby permitting the force of compression spring 92 to close valve plate 91 to compartment port 99.

Figure 5:
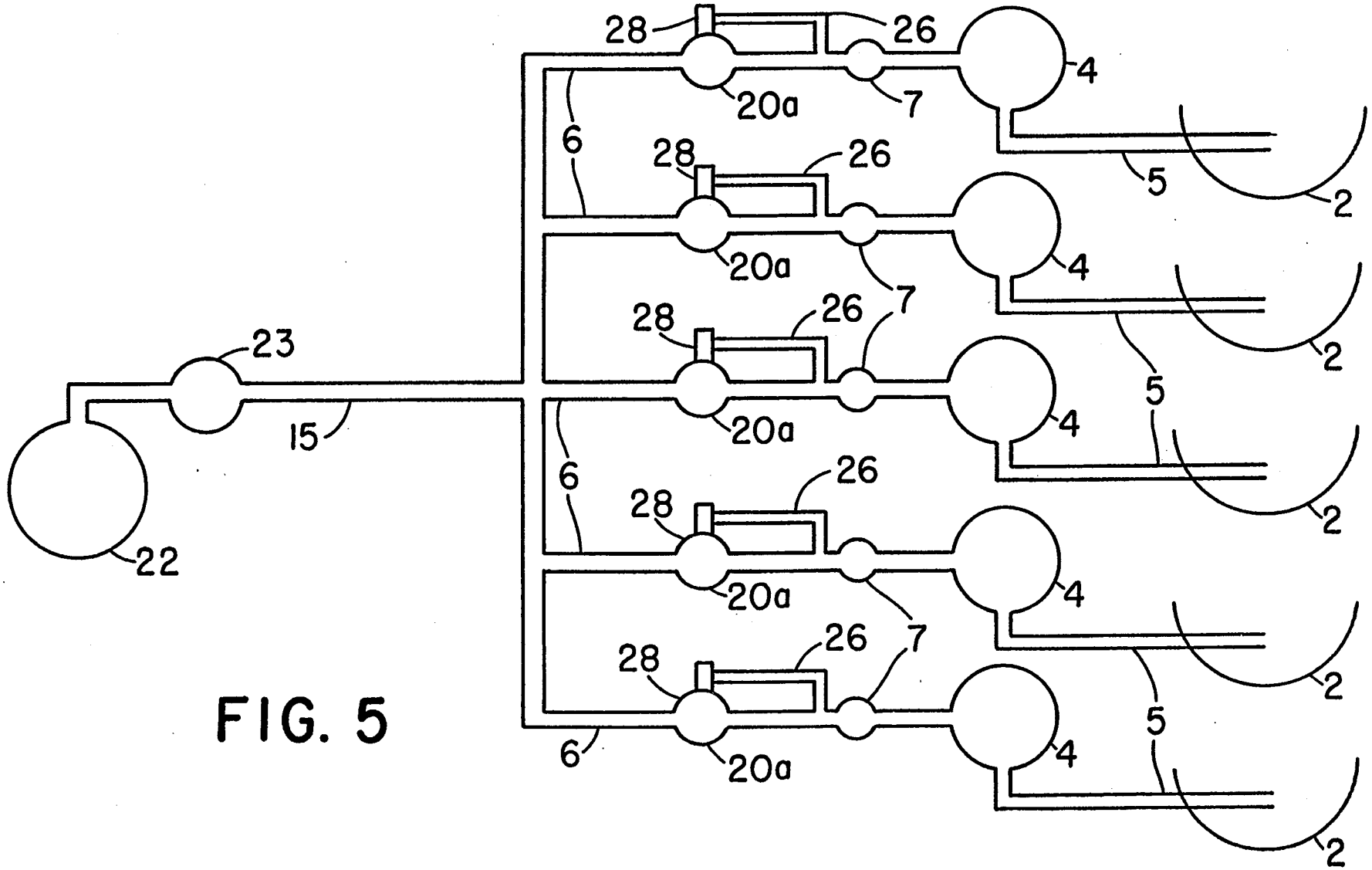
FIG. 5 is a schematic diagram according to the embodiment of FIG. 4 modified to provide automatic initiation and shut-off.

According to a further specific embodiment of the purge system shown in FIG. 4, the invention can be adapted to provide automatic initiation and shut-off. As illustrated in FIG. 5, the embodiment of FIG. 4 is modified such that (1) three-way control valve 24 is eliminated; (2) each flow control meter valve 20 is replaced with a solenoid-operated two-way valve 20*a*, such as the series ESM2011 sold by Versa Products Co., Inc. of Paramus, N.J.; (3) a separate back pressure conduit 26 is coupled to each flow control conduit between two-way valve 20*a* and one-way flow valve 7; and (4) a separate pressure switch 28, preferably a diaphram-type pressure switch such as the series EIS-H15 sold by Barksdale Controls Div., of Los Angeles, Calif., is coupled to the solenoid of each two-way valve 20*a* and is provided in flow communication with the corresponding flow control conduit 6 through back pressure conduit 26.

In addition, this embodiment may be further adapted to ensure that certain permissive conditions exist before initiation of the automatic purging operation can occur. For example, it is desired that the conventional loading procedure be completed, the compartment vapor valves 10 be opened, the vapor recovery couplers be connected to the cargo tank vapor recovery system, and the cargo tank brake interlock system 25 be activated before the automatic purging operation is initiated. To this end, the embodiment shown in FIG. 5 preferably includes a permissive condition sub-system which is coupled to the existing cargo tank pressurized air supply 80 (hereinafter "main air supply"). As shown in FIG. 5*b*, main air supply 80 is provided in flow communication with permissive condition pressure switch 88 by conduit 81. Conduit 81 includes normally-closed three-way control valve 82, branch conduit 83, and normally-open three-way control valve 84 positioned in series between main air supply 80 and permissive condition pressure switch 88. Three-way control valve 82 is coupled to the cargo tank vapor recovery system, such that when the loading facility vapor recovery coupler is connected to the cargo tank vapor recovery system, three-way control valve 82 will open and thereby permit pressurized air from main air supply 80 to flow through conduit 81. Branch conduit 83 is coupled to the tank compartment vapor valves 10 and the cargo tank brake interlock system 25, such that the flow of pressurized air through conduit 81 and into branch conduit 83 opens the tank compartment vapor valves 10 and activates the cargo tank brake interlock system 25.

Three-way control valve 84 is actuated by pilot valve 84*a*, which, in turn, is in flow communication with main air supply 80 by conduit 85. Conduit 85 includes normally-closed three-way control valve 86 and branch conduit 87 positioned in series between main air supply 80 and pilot valve 84*a*. Three-way control valve 86 is coupled to the cargo tank interference gate such that when the interference gate is lifted, as occurs during the conventional loading procedure, three-way control valve 86 will open and thereby permit pressurized air from main air supply 80 to flow through conduit 85 and activate pilot valve 84*a*, which, in turn, closes three-way control valve 84. Similarly, when the interference gate is closed, as normally occurs after completion of the conventional loading procedure, three-way control valve 86 will close and thereby shut off the flow of pressurized air from main air supply 80 through conduit 85 to pilot valve 84*a* which, in turn, opens three-way control valve 84. Branch conduit 87 is coupled to cargo tank brake interlock system 25, tank compartment valves (such as the valve assembly 60 shown in FIG. 8), and tank compartment vapor valves 10, such that the flow of pressurized air through conduit 85 and into branch conduit 87 activates the cargo tank brake interlock system 25, opens tank compartment valves, and opens the tank compartment vapor valves 10.

Figure 5A:
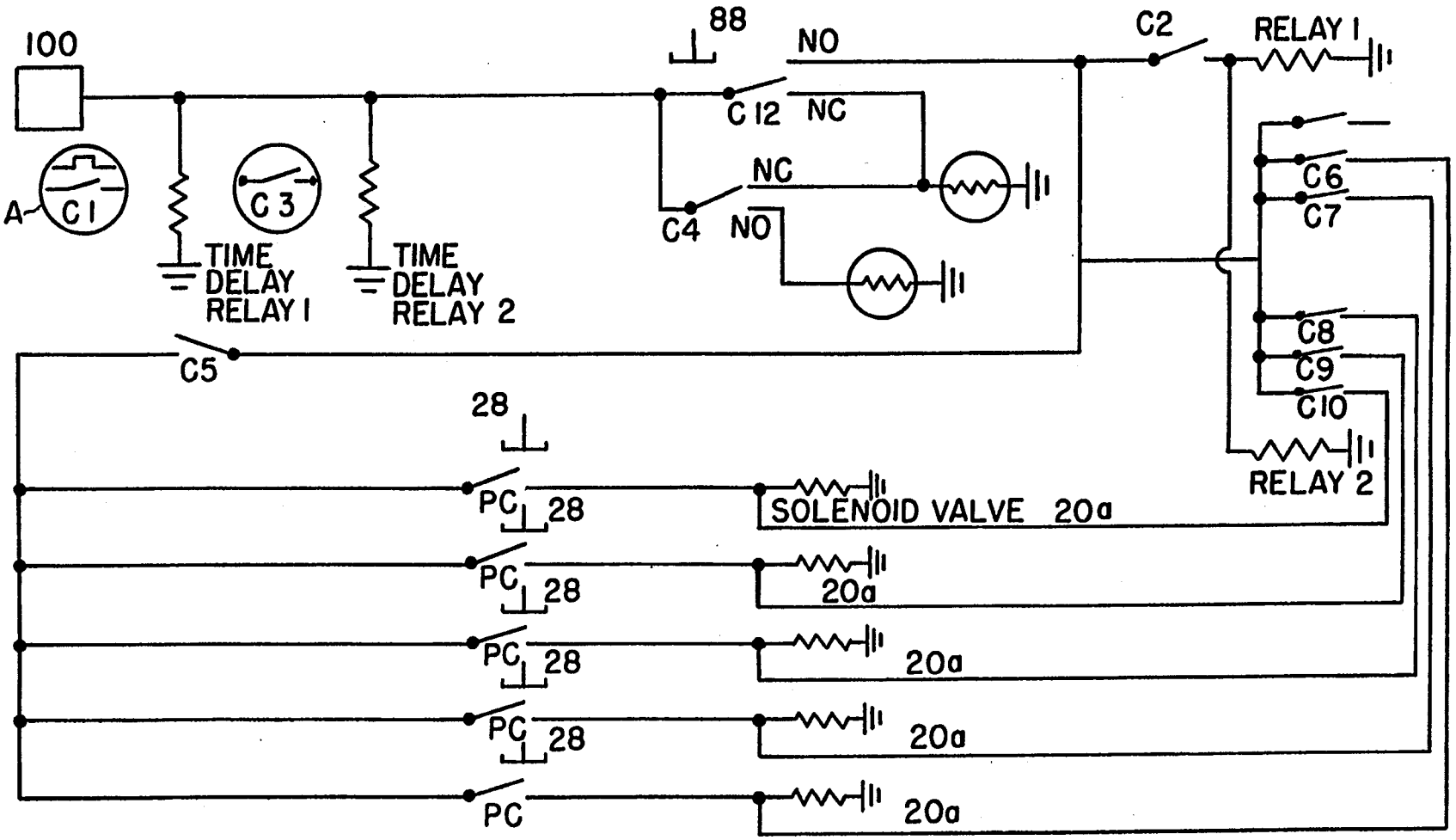
FIG. 5*a* is a schematic diagram of the electrical circuitry for the automatic initiation and shut-off feature for the embodiment described in FIG. 5.
Figure 5B:
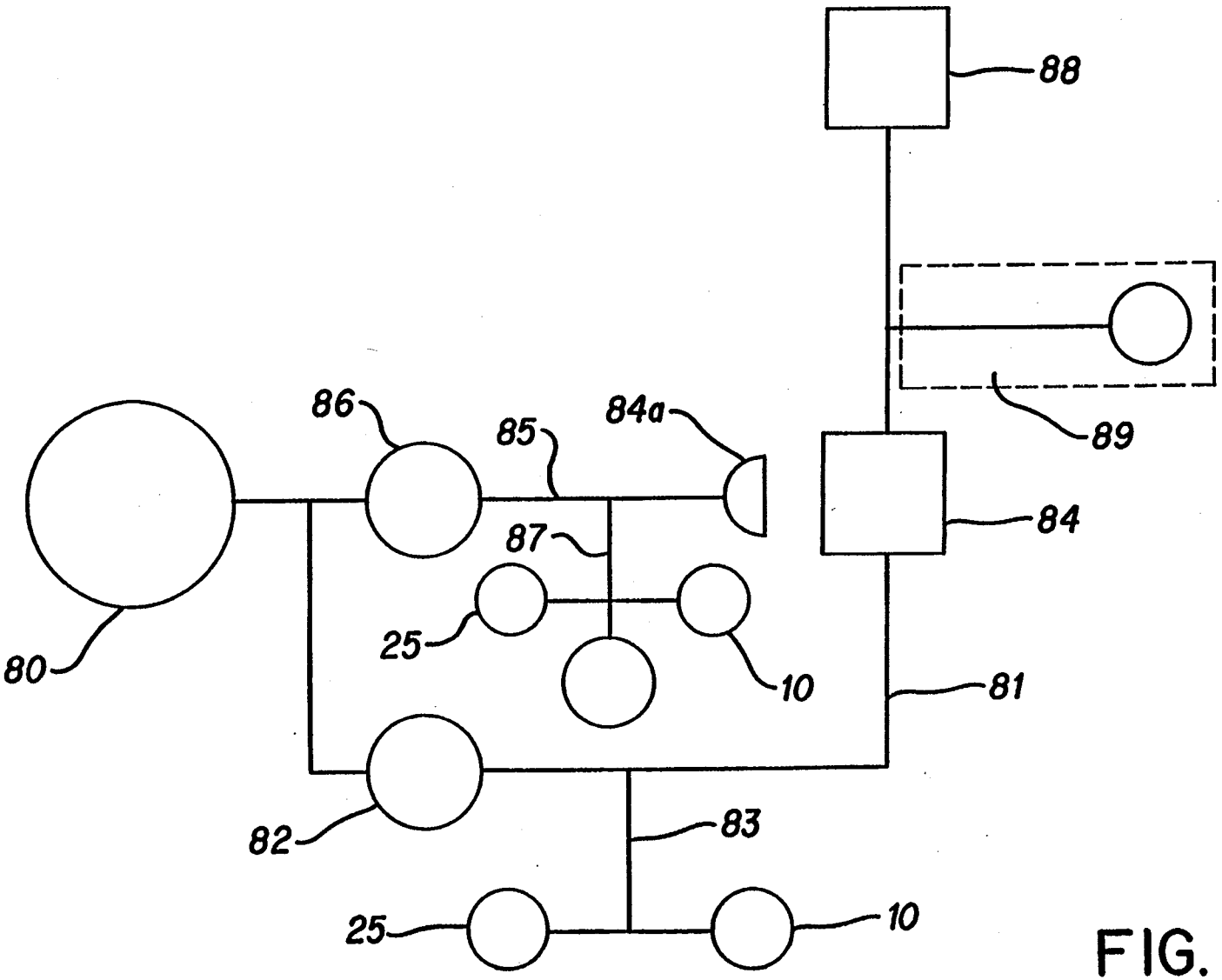
FIG. 5*b* is a schematic diagram of the permissive condition sub-system preferably included in the embodiment described in FIG. 5.

Referring now to FIG. 5*a*, permissive condition pressure switch 88 is adapted to enable initiation of the automatic purging operation by switching contact C12 to the normally-open position and thereby permit the flow of current from power supply 100 to solenoid-operated two way valves 20*a*. However, as shown in FIG. 5*b*, permissive condition pressure switch 88 will only enable the automatic purging operation if the desired permissive conditions are satisfied.

In operation, the permissive condition sub-system requires that the tank compartment vapor recovery system must be connected to the vapor recovery coupler and the cargo tank gate interference must be closed, thus indicating that the conventional loading procedure has been completed and the loading facility loading lines have been disconnected from the cargo tank wet lines, before permissive condition pressure switch 88 can enable the automatic purging operation. As here embodied, when the tank vapor recovery system is connected to the vapor recovery coupler, pressurized air flows from main air supply 80 through conduit 81 to three-way control valve 84 and through branch conduit 83 to activate the cargo tank brake interlock system 25 and open the tank compartment vapor valves 10. When the cargo tank interference gate is closed, the flow of pressurized air through conduit 85 is shut off and pilot valve 84*a* is deactivated, thereby opening three-way control valve 84 and permitting the flow of pressurized gas through conduit 81 to activate permissive condition pressure switch 88. It will be understood that when permissive condition pressure switch 88 is activated in this manner, contact C12 switches to the normally-open position indicated in FIG. 5*a* and thereby enables the automatic purging operation.

As described with reference to the electrical schematic diagram shown in FIG. 5*a*, the automatic purging operation is actuated by pressing the start button (indicated at A) which manually closes contact C1 and thereby permits the flow of current from power supply 100 to activate time delay relay TDR1. Activation of TDR1, in turn, closes contacts C2 and C3 for a predetermined time interval, for example, 5 to 10 seconds. Assuming that the permissive conditions described above have been satisfied such that contact C12 is in the normally-open position, closure of contact C2 energizes relays R1 and R2 which, in turn, close contacts C6, C7, C8, C9 and C10 for the same 5 to 10 second time interval. Closure of these contacts permits the flow of current from power supply 100 to each normally-closed solenoid valve 20*a*, which thereby opens the solenoid valves and permits pressurized gas to flow from the source of pressurized gas into the wet lines for the same 5 to 10 second time period. Closure of contact C3 simultaneously activates time delay relay TDR1, which, in turn, closes contacts C4 and C5 for about the maximum anticipated time for completing the purging operation, e.g., 2 minutes. Closure of double throw contact C4 will deactivate the system indicator "OFF" light and activate the system indicator "ON" light. Closure of contact C5 will provide current from power source 100 to normally open pressure control contacts PC.

During the 5 to 10 second purge initiation sequence, pressure switches 28 will detect the back pressure from each corresponding wet line. It will be understood that because of the resistance provided by the liquid material in each wet line, the pressure in a wet line 4 and, therefore, the back pressure in each corresponding back pressure conduit 26 will be greater for a wet line which is being purged of liquid material than for a wet line which already has-been purged. Accordingly, each pressure switch 28 is adapted to close the corresponding pressure control contact PC when the pressure detected in the corresponding back pressure conduit 26 is above a pre-determined level which indicates that the wet line 4 is being purged of liquid material. Similarly, each pressure switch 28 is adapted to open the corresponding pressure control contact PC when the pressure detected in back pressure conduit 26 drops below the pre-determined level which indicates that the wet line 4 has been purged of liquid material.

Therefore, to the extent that each wet line is still being purged of residual liquid material after the 5 to 10 second purge initiation sequence has elapsed, each pressure switch 28 will close the corresponding pressure control contact PC and keep the corresponding solenoid valve 20*a* open thereby permitting the continued flow of pressurized gas into the wet line. When-each pressure switch 28 detects a drop in the pressure which indicates that the corresponding wet line has been virtually completely purged of the residual liquid material, each pressure switch 28 will open the corresponding pressure control contact PC and thereby close the corresponding solenoid valve 20*a*. Thus, after all the flow control valves 20*a* are initially opened for 5 to 10 seconds, each solenoid valve will close independent of the other solenoid valves when the pressure in the corresponding wet line 5 indicates that the wet line has been purged of virtually all of the residual liquid material. The purging operation is completed when all wet lines 4 have been purged of liquid material and solenoid-operated flow control valves 20*a* have closed.

Alternatively, solenoid valves 20*a* may be entirely controlled by a time-based mechanism, such that the valves are simultaneously opened for a pre-determined time interval —preferably, the maximum anticipated time for completing the purging operation, e.g., 2 minutes—before they simultaneously close. Such an arrangement would obviate the need to use back pressure conduits 26, pressure switches 28, and the related circuitry described in FIG. 5*a*.

According to another feature of the invention, the embodiment-shown in FIG. 5 may be further adapted to perform a quick purge operation. The quick purge operation reduces the time required to purge the wet lines by the introduction of more highly pressurized gas into the wet lines. To this end, pressure regulator 23 in conduit 15, which was adapted to provide a constant flow of pressurized gas to the plurality of wet lines 4 at, for example, 5 PSI for the standard purging operation described above with reference to FIG. 5, is now adapted to provide a constant flow of more highly pressurized gas to the plurality of wet lines 4 at, for example, 30 PSI.

In addition, the tank compartment valves are preferably modified to provide for a greater closing force such that the tank compartment valves remain closed despite the introduction of more highly pressurized gas into the wet lines during the quick purge operation. For example, the dual functioning compartment valve (indicated generally at 40 in FIG. 9) which is advantageously used in embodiments having the preferred internal purging conduit (indicated at 5 in FIG. 2), is modified, as shown in FIG. 11, to include a pressurized air source 52 coupled through flow conduit 54 to chamber 50 via air duct 48. As here embodied, when the quick purge operation is actuated, pressurized air is permitted to flow from pressurized air source 52 through conduit 54 and into chamber 50. Pressurization of chamber 50 exerts a downward force on piston 43 which is transmitted through hollow shaft 41 to valve plate 45. It will be understood that the downward force exerted on valve plate 45 is selected to be greater than the upward force against valve plate 45 resulting from the increased pressurization of wet line 4 during the quick purge operation such that valve plate 45 and hollow shaft 41 remain sealed to compartment port 3 and valve seat 37, respectively. Similarly, with reference to embodiments of the present invention which use the external purging conduit (indicated at 5*a* in FIG. 2*a*), the compartment valve can likewise be modified to provide an additional closing force for use in the quick purge operation.

Preferably, embodiments of the present invention which are adapted to perform this quick purge operation are also adapted to provide for automatic initiation and shut-off. To this end, embodiments of the present invention which are capable of performing the quick purge operation include the same electrical circuitry and essentially the same permissive condition sub-system described above with reference to FIGS. 5*a* and 5*b*, respectively. As shown in FIG. 5*b*, the permissive condition sub-system is modified such that conduit 81 includes second branch conduit 89 positioned between three-way control valve 84 and permissive condition pressure switch 88. Branch conduit 89 provides flow communication between conduit 81 and quick purge dual functioning compartment valves 40, such that pressurized air flowing through conduit 81 and into branch conduit 89 is introduced into dual functioning tank compartment chamber 50 to provide an over-compensating closing force on valve plate 45 as described above with reference to FIG. 9. Accordingly, when the cargo tank interference gate is closed and the vapor recovery couplers are connected to the cargo tank vapor recovery system, pressurized air will flow through conduit 81, branch conduit 83, and branch conduit 89 to: (1) activate the cargo tank brake interlock system 25; (2) open the compartment vapor valves 10; (3) provide an over-compensating closing force on quick purge dual functioning compartment valve 40; and (4) activate permissive condition pressure switch 88 and thereby enable automatic initiation of the quick purge operation. After the automatic quick purge operation is enabled, the quick purge operation functions in the same manner as the standard purge operation described above with reference to FIGS. 5 and 5*a*.

Figure 6:
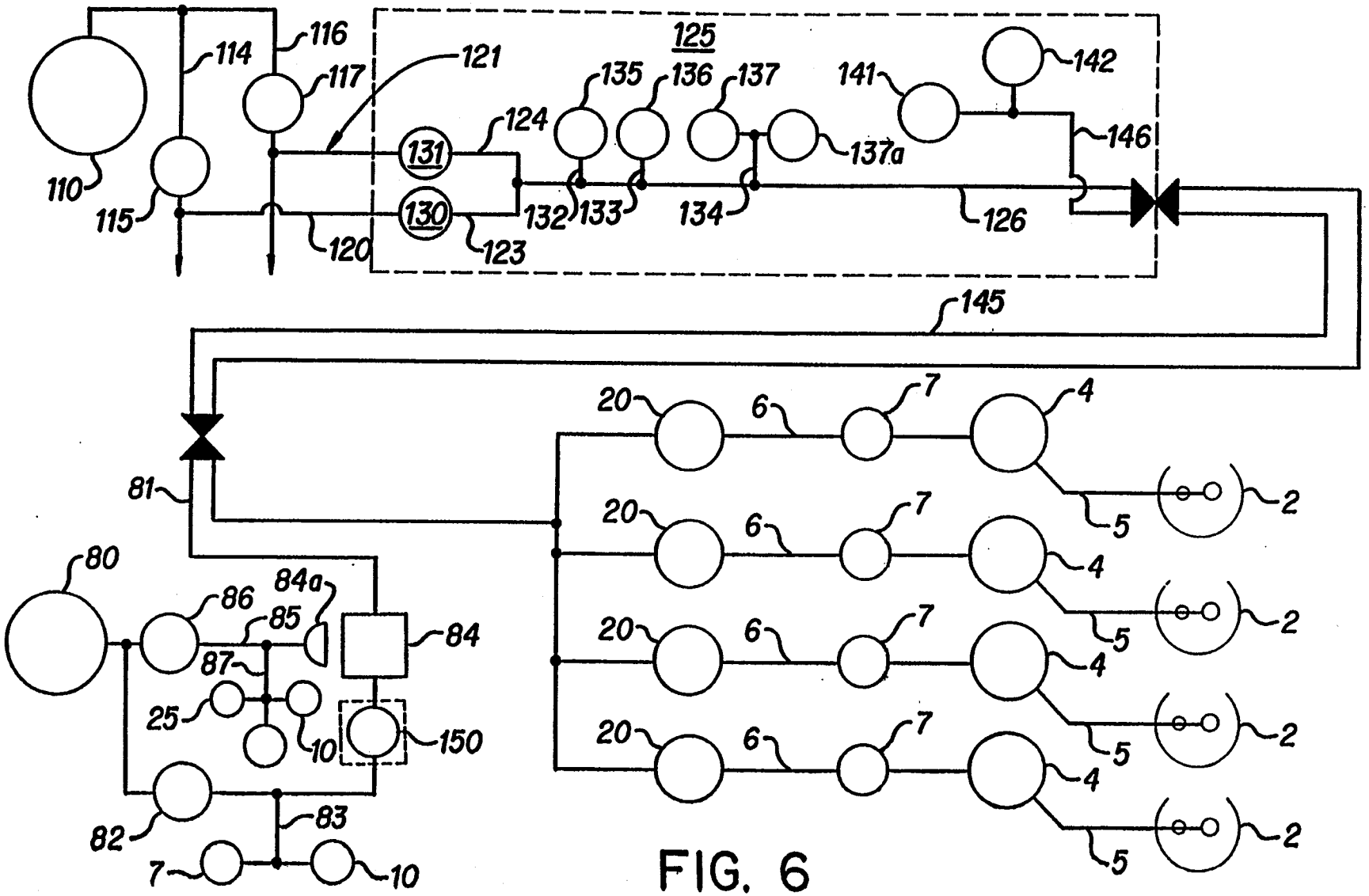
FIG. 6 is a schematic diagram of an alternative embodiment of a wet line purging apparatus according to the present invention.

In an alternative form of the invention, the system is partly contained on the cargo loading facility and partly contained on the cargo tank. According to one embodiment of this form as illustrated in FIG. 6, the cargo loading facility houses a container of pressurized inert gas 110 which distributes pressurized inert gas, such as carbon dioxide or nitrogen, through main feed line 112 to low pressure branch line 114 and high pressure branch line 116. Pressure regulator 115 is located in low pressure branch line 114 immediately after the junction with main feed line 112 for providing a constant inert gas pressure to wet lines 4 at, for example, 5 PSI. Similarly, pressure regulator 117 is located in high pressure branch line 116 immediately after the junction with main feed line 112 for providing a constant inert gas pressure to wet lines 4 at, for example, 30 PSI. Both low pressure branch line 114 and high pressure branch line 116 are coupled to a plurality of low pressure flow lines 120 and high pressure flow lines 121, respectively. Each low pressure flow line 120 and high pressure flow line 121 leads to a separate bay of the cargo loading facility.

Each cargo loading facility bay preferably includes a control box (indicated generally at 125), wherein lead conduit 126 is provided in flow communication with low pressure flow line 120 and high pressure flow line 121 through conduits 123 and 124, respectively. Both conduits 123 and 124, preferably, include normally-closed solenoid-operated valves (indicated at 130 and 131, respectively) which, when opened, permit the flow of pressurized inert gas into lead conduit 126. Lead conduit 126, preferably, includes first branch conduit 132, second branch conduit 133, and third branch conduit 134 which, in turn, are coupled, respectively, to low pressure switch 135, pressure shutdown switch 136, and excess flow switches 137 and 137*a*. In addition, control box 125 includes air conduit 140 which is coupled to interference gate pressure switch 141 and purge selector pressure switch 142.

Excess flow switches 137 and 137*a* are adapted to shut down the standard purge operation and the quick purge operation, respectively, when the purging apparatus malfunctions. To this end, excess flow switches 137 and 137*a* may, for example, be the model V6EPBBSLF Flotect switches sold by W. E. Anderson. It will be understood that when the purging apparatus malfunctions the flow rate of pressurized gas through lead conduit 126 will be greater than the flow rate of pressurized gas through lead conduit 126 in a properly functioning purging apparatus. For example, if either a conduit in the purging apparatus is broken or the flow control meter valves 20 are improperly adjusted, the flow rate of pressurized gas through lead conduit 126 during the purging operation will exceed the normally anticipated flow rate of pressurized gas through lead conduit 126 in a properly functioning purging apparatus. In addition, because the flow rate of pressurized gas during the quick purge operation exceeds the flow rate of pressurized gas during the standard purge operation, the apparatus incorporates a standard purge excess flow switch 137 and a quick purge excess flow switch 137*a*. Accordingly, during the standard purge operation, excess flow switch 137 is enabled to detect the flow rate of pressurized gas through lead conduit 126 and shut down the standard purge operation when the flow rate exceeds a prescribed limit. Similarly, during the quick purge operation, excess flow switch 137*a* is enabled to detect the flow rate of pressurized gas through lead conduit 126 and shut down the quick purge operation when the flow rate exceeds a prescribed limit.

Low pressure switch 135 is adapted to detect the pressure of the pressurized gas flowing through lead conduit 126 and provide a warning signal to the operator if the pressure of the pressurized gas flowing through lead conduit 126 is below the pre-determined optimal level. To this end, low pressure switch 135 may, for example, be a diaphram-type pressure switch such as the model EIS-H90 sold by Barksdale Controls Div. of Los Angeles, Calif.. Accordingly, when low pressure switch 135 detects that the pressure of pressurized gas flowing through lead conduit 135 is at such a low level as to indicate that container of pressurized gas 110 is no longer optimally pressurized, low pressure switch 135 will act to illuminate low pressure warning light (indicated at 135*a* in FIG. 6*a*).

Pressure shutdown switch 136 is adapted to detect the pressure of the pressurized gas flowing through lead conduit 126 and shut down the purging operation when the pressure of the pressurized gas flowing through lead conduit 126 is at such a low level that wet lines 4 will not be operatively purged. To this end, pressure shutdown switch 136 may also, for example, be a diaphram-type pressure switch such as the model EIS-H90 sold by Barksdale Controls Div. of Los Angeles, Calif. Accordingly, when pressure shutdown switch 136 detects that the pressure of pressurized gas flowing through lead conduit 126 is at such a low level as to indicate that the wet lines 4 will not be operatively purged, pressure shutdown switch 136 will shut down the purging operation and illuminate pressure shutdown light (indicated at 136*a* in FIG. 6*a*).

As shown in FIG. 6, loading facility control box lead conduit 126 and air conduit 140 are provided in flow communication with the cargo tank wet lines 4 and existing cargo tank main air supply 80, respectively, through bi-connector 145. It will be understood that main air supply 80 is coupled to air conduit 140 to provide essentially the same permissive condition sub-system as described above with reference to FIGS. 5, 5*a* and 5*b*. As here embodied, the permissive condition sub-system includes the same conduit 81, normally-closed three-way control valve 82, branch conduit 83, normally-open three-way control valve 84, pilot valve 84*a*, conduit 85, normally-closed three-way control valve 86, and branch conduit 87 as described above with reference to FIG. 5*b*. In addition, cargo tanks equipped to perform the quick purge operation further include a quick purge pressure regulator 150 positioned between branch line 83 and three-way control valve 84 in conduit 81. Quick purge pressure regulator 150 functions to decrease the pressure of pressurized air from main air supply 80 through conduit 81 from, for example, 60 PSI to, for example, 25 PSI.

As further shown in FIG. 6, wet lines 4 are provided in flow communication with bi-connector 145 through a plurality of flow control conduits 6. Each flow control conduit 6 preferably includes a flow control meter valve 20, such as the series K75 sold by King Instruments Co. of Huntington Beach, Calif., which can be adjusted and calibrated to regulate the flow of pressurized gas by varying the size of the valve orifice. As discussed above with reference to FIG. 3, it will be understood that the size of the valve orifice for each flow control meter valve 20 will be set such that all of the wet lines will be virtually completely purged within the same purging operation time. Also, one-way flow valve 7 may be located downstream of flow control meter valve 20 to prevent the flow of pressurized gas and liquid material from wet line 4 back into flow control conduit 6. It will be understood that this embodiment preferably includes the same internal purging conduit 5, dual functioning compartment valve 40, and piping connector 30 as described above with reference to FIGS. 8, 9 and 10.

Prior to the operation of the quick purge system as shown in FIG. 6, bi-connector 145 must be connected at one end to the loading facility control box and at the other end to the cargo tank. Provided that loading of the tank compartments has been completed, the vapor recovery adapter is connected to the cargo tank compartment vapor recovery system, and the interference gate has been closed, pressurized air from main air supply 80 will flow through conduit 81, hi-connector 145 and into loading facility control box air conduit 140 where it will activate purge selector pressure switch 142 and gate interference pressure switch 141.

Purge selector pressure switch 142 is adapted to enable either the standard purge operation using the lower pressurized gas distributed from container 110 through low pressure branch line 114 or the quick purge operation using the higher pressurized gas distributed from container 110 through high pressure branch line 116. As embodied in FIG. 6, main air supply 80 preferably distributes pressurized air at 60 PSI into conduit 81. However, as discussed above, if the cargo tank is equipped to perform the quick purge operation, conduit 81 will include pressure regulator 150 which functions to decrease the pressure of the pressurized gas entering air conduit 140 to, for example, 25 PSI. Therefore, if the cargo tank is adapted to perform the standard purge operation main air pressurized at about 60 PSI will flow through conduit 81 into air conduit 140; whereas, if the cargo tank is adapted to perform the quick purge operation main air pressurized at about 25 PSI will flow through conduit 81 into air conduit 140. Accordingly, when purge selector pressure switch 142 detects pressurized main air at greater than about 25 PSI, purge selector pressure switch is adapted to enable the standard purge operation using the lower pressurized gas. Similarly, when purge selector pressure switch 142 detects pressurized air at about 25 PSI, purge selector pressure switch is adapted to enable the quick purge operation using the higher pressurized gas.

Interference gate pressure switch 141 is adapted to ensure that the purging operation will not be initiated unless certain permissive conditions are satisfied. To this end, interference gate pressure switch 141 will only enable the purging operation if the cargo tank interference gate is closed, the vapor recovery adaptor is connected to the cargo tank vapor recovery system, the cargo tank brake interlock system is activated, and the tank compartment vapor valves are opened. As here embodied, interference gate pressure switch 141 is adapted to enable the purging operation upon detecting pressurized air in air conduit 140 at greater than, for example, 20 PSI. Therefore, if the vapor recovery coupler is connected to the tank compartment vapor recovery system, the cargo tank gate interference is closed, and bi-connector 145 is coupled to both the loading facility control box 125 and the cargo tank, pressurized air is permitted to flow from main air supply 80 to interference gate pressure switch 141. As discussed above with reference to the purge selector pressure switch 142, the main air in air conduit 140 will be greater than 20 PSI and gate interference pressure switch 141 will enable the purging operation.

In operation, the embodiment illustrated in FIG. 6 can be adapted to provide automatic initiation and shut-off as described with reference to the schematic diagram shown in FIG. 6*a*. Assuming that the automatic purging system is in a normal ready mode, contact C18 will be in the normally-opened position and contacts C4 and C11 will be closed, thereby providing current from power supply 100 to illuminate ready light 155. To this end, initiation of the purging system is actuated by pressing the start button (indicated generally at A) which closes contacts C1 and C2. Closure of contact C1 permits the flow of current from power supply 100 to activate magnetic latching relay MLR1, which, in turn, closes normally-open contact C3 and opens normally-closed contact C4. When contact C4 opens, ready light 155 is deactivated. Assuming that the interference gate is closed and the tank compartment vapor recovery system is connected to the vapor recovery coupler, interference gate pressure switch 141 transfers contact C6 to the normally-open position, such that the closure of contact C3 will provide current from power supply 100 to contact C20. If the automatic purging system is actuated while the interference gate is open or the vapor recovery coupler is not connected to the tank compartment vapor recovery system, current from power source 100 will illuminate gate interference light 141*a*.

Depending upon whether the cargo tank is equipped for the standard purge operation or the quick purge operation as described above with reference to FIG. 6, purge selector pressure switch 142 will transfer contact C20 to the normally-opened position or the normally-closed position, respectfully. For example, if purge selector pressure switch 142 detects a pressure in air conduit 140 which indicates that the cargo tank is adapted for the quick purge operation, purge selector pressure switch 142 transfers contact C20 to the normally-closed position, thereby providing the flow of current to time delay relay TDR2. When energized in this manner, TDR2 is adapted to close contacts C21 and transfer contact C22 to the normally-closed position for about the maximum anticipated time for completing the quick purge operation, e.g., 30 seconds. Closure of contact C21 illuminates the quick purge operation indicator "ON" light. When contact C22 is in the normally-closed position current from power supply 100 energizes and thereby opens normally-closed solenoid-operated valve 131, thus permitting the flow of highly pressurized gas from pre-pressurized container 110 to wet lines 4. After the 30 second time period has elapsed, TDR2 will de-energize and thereby open contact C21 and transfer contact C22 to the normally-open position. When contact C22 is in the normally-open position, current from power supply 100 will simultaneously energize relay R2 and time delay relay TDR3. Energized relay R2 acts to close contact C23. In addition, time delay relay TDR3 is adapted to close contact C14 and transfer contact C15 to the normally-closed position for a pre-determined time duration of, for example, 30 seconds.

Closure of contacts C14 and C23 provides the flow of current to further energize and open solenoid-operated valve 131, thus permitting the continued flow of pressurized gas from pre-pressurized container 110 to wet lines 4. When contact C15 is transferred to the normally-closed position, indicator light 150 is illuminated, thus alerting the operator to determine by observation through a sight glass whether the wet lines 4 have been virtually completely purged of liquid material. If it is determined that the wet lines 4 have been virtually completely purged of liquid material, the operator presses the stop button (indicated generally at B) thereby closing contact C17 and deactivating magnetic latching relay MLR1. De-activation of MLR1 opens contact C3 and thereby closes solenoid-operated valve 131. Closure of solenoid-operated valve 131 terminates the purging operation by shutting off the flow of pressurized gas into wet lines 4.

Similarly, if purge selector pressure switch 142 detects a pressure in air conduit 140 which indicates that the cargo tank is adapted for the standard purge operation, purge selector pressure switch 142 transfers contact C20 to the normally-opened position, thereby providing current to time delay relay TDR2a, R4 and R5. When energized, TDR2a is adapted to close contact C31 and transfer contact C32 to the normally-closed position for about the maximum anticipated time for completing the standard purge operation, e.g., 2 minutes. Closure of contact C31 illuminates the standard purge operation indicator "ON" light. When contact C32 is in the normally-closed position, current from power supply 100 energizes and thereby opens normally-closed solenoid-operated valve 130, thus permitting the flow of pressurized gas from pre-pressurized container 110 to wet lines 4. After the 2 minute time period has elapsed, TDR2a will de-energize and thereby open contact C31 and transfer contact C32 to the normally-opened position. It will be understood that when the purging operation is initiated, contact C26 is closed and contact C25 is opened. However, while relay R4 is energized, contact C26 opens and contact C25 closes. When contact C32 is in the normally-opened position, current from power supply 100 will simultaneously energize relay R3 and time delay relay TDR3. Energized relay R3 acts to close contact C33. In addition, time delay relay TDR3 is adapted to close contact C14 and transfer contact C15 to the normally-closed position for a pre-determined time duration of, for example, 30 seconds. Closure of contacts C14 and C33 provides the flow of current to further energize and open solenoid-operated valve 130, thus permitting the continued flow of pressurized gas from pre-pressurized container 110 to wet lines 4. When contact C15 is transferred to the normally-closed position, indicator light 150 is illuminated, thus alerting the operator to determine by observation through a sight glass whether the wet lines 4 have been virtually completely purged of liquid material. If it is determined that the wet lines 4 have been virtually completely purged of liquid material, the operator presses the stop button (indicated generally at B) thereby closing contact C17 and de-activating magnetic latching relay MLR1. De-activation of MLR1 opens contact C3 and thereby closes solenoid-operated valve 130. Closure of solenoid-operated valve 130 terminates the purging operation by shutting off the flow of pressurized gas into wet lines 4. If the operator fails to make a determination as to whether the wet lines have been virtually completely purged of liquid material within the pre-determined time duration of TDR3, contact C14 will open and contact C15 will transfer to the normally-opened position. When contact C14 opens, solenoid-operated valve 130 closes and shuts off the flow of pressurized gas to wet lines 4. In addition, the transfer of contact C15 to the normally-opened position illuminates shut-down indicator light 151.

Figure 6A:
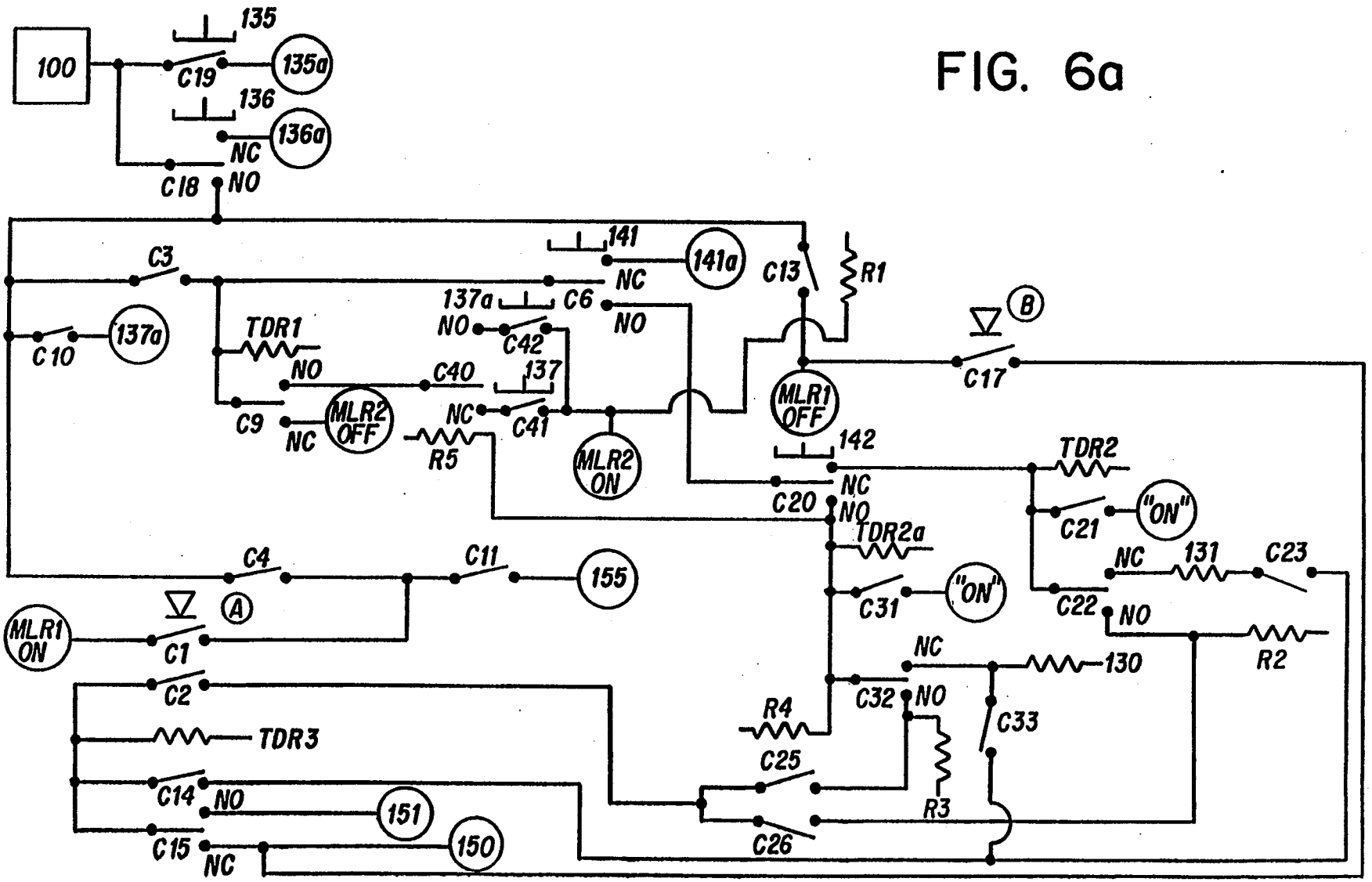
FIG. 6*a* is a schematic diagram of the electrical circuitry for the automatic initiation and shut-off feature for the embodiment described in FIG. 6.

In addition, the automatic system shown in FIG. 6*a* is adapted to automatically shut down the purging operation when the purging apparatus malfunctions. To this end, according to the purging operations described above closure of contact C3 will also provide current from power supply 100 to energize time delay relay TDR1, which, in turn, transfers contact C9 to the normally-closed position for about 10 seconds. When contact C9 is in the normally-closed position, current from power supply 100 activates magnetic latching relay MLR2, which, in turn, opens contact C10 and closes contact C11. After the 10 second period has elapsed, contact C9 transfers to the normally-open position and thereby permits current to flow from power supply 100 to contact C40. As described above with reference to FIG. 6, this purging apparatus includes excess flow switch 137 for use during the standard purge operation and excess flow switch 137*a* for use during the quick purge operation. In order to enable the corresponding excess flow switch with the appropriate purging operation, contact C40 is adapted to be in the normally-closed position during the standard purge operation and the normally-opened position during the standard purge operation.

Accordingly, contact C40 is in the normally-opened position when the purging operation is initiated. As described above, upon detecting that the cargo tank is equipped for the standard purge operation, purge selector pressure switch 142 transfers contact C20 to the normally-opened position to provide current to relay R5, TDR2a and R4 When relay R5 is energized in this manner, contact C40 is transferred to the normally-closed position to enable excess flow switch 137 during the standard purge operation. Conversely, upon detecting that the cargo tank is equipped for the quick purge operation, purge selector pressure switch 142 transfers contact C20 to the normally-closed position and contact C40 remains in the normally-closed position to enable excess flow switch 137*a* during the quick purge operation. As the purging operation continues, if excess flow switch 137 or 137*a* detects a flow rate of pressurized gas in lead conduit 126 which indicates that the purging apparatus is malfunctioning, contact C41 or C42, respectively, will close. Closure of contact C41 or C42 will provide current from power supply 100 to activate magnetic latching relay MLR2 and energize relay R1. Activating MLR2 opens contact C11 and closes contact C10, which provides current to illuminate excess flow light 137*b*. When relay R1 is energized, contact C13 closes to provide current from power supply 100 to deactivate MLR1, which, in turn, opens contact C3 and closes contact C4. Opening contact C3 discontinues the flow of current to enabled solenoid-operated valve 130 or 131 and thereby closes enabled solenoid-operated valve 130 or 131. Closure of enabled solenoid-operated valve 130 or 131, discontinues the flow of pressurized gas into wet lines 4 and thereby shuts down the purging operation.

Similarly, the automatic purging operation provided in FIG. 6*a* includes an automatic shutdown feature if the pressurized gas flowing through lead conduit 126 is at such a low level that it will not operatively purge the cargo tank wet lines. To this end, when pressure shutdown switch 136 detects that the pressurized gas in lead conduit 126 is below the prescribed limit, pressure shutdown switch 136 will act to switch contact C18 to the normally-closed position and thereby illuminate pressure shutdown light 136*a* and shutdown the purging operation.

While only a few embodiments have been illustrated and described in connection with the present invention, various modifications and changes in both the apparatus and method will become apparent to those skilled in the art. All such modifications or changes falling within the scope of the claims are intended to be included therein.

We claim:

1. A method for removing residual liquid in each cargo tank external loading line of a cargo tank vehicle after a cargo tank compartment associated with the cargo tank external loading line has been loaded comprising the steps of:

a) closing off each cargo tank external loading line to provide a generally sealed chamber within the cargo tank external loading line;

b) pressurizing the cargo tank external loading line to force the residual liquid out of the cargo tank external loading line; and c) leading the residual liquid from the cargo tank external loading line into the cargo tank compartment associated with the cargo tank external loading line through a separate purging conduit having an inlet end in flow communication with the generally sealed chamber within the cargo tank external loading line and an outlet end in flow communication with the cargo tank compartment, such that the cargo tank external loading line is substantially liquid free to allow safer transport and ensure minimal risk of spillage in the event of an under-ride accident.

2. A method according to claim 1, wherein said step of leading residual liquid from the cargo tank external loading line into the cargo tank compartment is carried out by removing liquid at generally the lowest point of the generally sealed chamber within the cargo tank external loading line to maximize the amount of residual liquid removed from the cargo tank external loading line.

3. A method according to claim 2, wherein said pressurizing step is carried out by using vapors from liquid stored in the cargo tank compartment.

4. A method according to claim 1, wherein the separate purging conduit used for carrying out said step of leading residual liquid from the cargo tank external loading line into the cargo tank compartment is positioned essentially entirely inside the cargo tank external loading line.

5. A method according to claim 1, wherein the separate purging conduit used for carrying out said step of leading residual liquid from the cargo tank external loading line into the cargo tank compartment is positioned essentially entirely outside the cargo tank external loading line.

6. A method for removing residual liquid in each cargo tank external loading line of a cargo tank vehicle after a cargo tank compartment associated with the cargo tank external loading line has been loaded comprising the steps of:

(a) closing off each cargo tank external loading line to provide a generally sealed chamber;

(b) pressurizing the cargo tank external loading line using vapors from liquid stored in the cargo tank compartment to force the residual liquid out of the cargo tank external loading line; and (c) leading the residual liquid from generally the lowest point in the cargo tank external loading line into the cargo tank compartment associated with the cargo tank external loading line, is substantially liquid free to allow safer transport and ensure minimal risk of spillage in the event of an under-ride accident.

* * * * *